US008075337B2

(12) United States Patent
Malloy et al.

(10) Patent No.: US 8,075,337 B2
(45) **Date of Patent: *Dec. 13, 2011**

(54) CABLE CONNECTOR

(75) Inventors: Allen L. Malloy, Elmira Heights, NY (US); Charles Thomas, Athens, PA (US); Mike Dean, Waverly, NY (US); Bruce Hauver, Sr., Elmira, NY (US)

(73) Assignee: Belden Inc., St. Louis, MO (US)

( * ) Notice: Subject to any disclaimer, the term of this patent is extended or adjusted under 35 U.S.C. 154(b) by 113 days.

This patent is subject to a terminal disclaimer.

(21) Appl. No.: 12/568,179

(22) Filed: Sep. 28, 2009

(65) Prior Publication Data

US 2010/0081322 A1 Apr. 1, 2010

Related U.S. Application Data

(60) Provisional application No. 61/101,185, filed on Sep. 30, 2008, provisional application No. 61/101,191, filed on Sep. 30, 2008, provisional application No. 61/155,246, filed on Feb. 25, 2009, provisional application No. 61/155,249, filed on Feb. 25, 2009, provisional application No. 61/155,250, filed on Feb. 25, 2009, provisional application No. 61/155,252, filed on Feb. 25, 2009, provisional application No. 61/155,289, filed on Feb. 25, 2009, provisional application No. 61/155,297, filed on Feb. 25, 2009, provisional application No. 61/175,613, filed on May 5, 2009, provisional application No. 61/242,884, filed on Sep. 16, 2009.

(51) Int. Cl.
*H01R 13/60* (2006.01)

(52) U.S. Cl. ..... 439/578; 439/322

(58) Field of Classification Search ..... 439/578, 439/587, 595, 584, 607.19, 322
See application file for complete search history.

(56) References Cited

U.S. PATENT DOCUMENTS 1,734,506 A 11/1929 Walter
2,258,737 A 10/1941 Browne
2,394,351 A 2/1946 Wurzburger (Continued)

FOREIGN PATENT DOCUMENTS

CA 2096710 11/1994

(Continued)

OTHER PUBLICATIONS

Notice of Allowance for U.S. Appl. No. 12/568,160, mail date Apr. 18, 2011, 8 pages.

(Continued)

*Primary Examiner* — Tulsidas C Patel
*Assistant Examiner* — Phuong T Nguyen
(74) *Attorney, Agent, or Firm* — Foley & Lardner LLP

(57) ABSTRACT

A cable connector configured to couple a cable to another connector or piece of video or audio equipment may include a connector body, a nut, an annular post and a biasing element. The connector body may include a forward end and a rearward end, where the forward end is configured to connect to the second connector and the rearward end is configured to receive a coaxial cable. The nut may be rotatably coupled to the forward end of the connector body and the annular post may be disposed within the connector body. The annular post may also include an annular notch located at the forward end of the connector body. The biasing element may be located in the annular notch.

24 Claims, 16 Drawing Sheets

U.S. PATENT DOCUMENTS

| | | | |
|---|---|---|---|
| 2,460,304 | A | 2/1949 | McGee et al. |
| 2,544,654 | A | 3/1951 | Brown |
| 2,544,764 | A | 3/1951 | Parkes |
| 2,549,647 | A | 4/1951 | Turenne |
| 2,694,187 | A | 11/1954 | Nash |
| 2,728,895 | A | 12/1955 | Quackenbush et al. |
| 2,754,487 | A | 7/1956 | Carr et al. |
| 2,757,351 | A | 7/1956 | Klostermann |
| 2,761,110 | A | 8/1956 | Edlen et al. |
| 2,762,025 | A | 9/1956 | Melcher |
| 2,805,399 | A | 9/1957 | Leeper |
| 2,870,420 | A | 1/1959 | Malek |
| 2,983,893 | A | 5/1961 | Jackson |
| 2,999,701 | A | 9/1961 | Blair et al. |
| 3,040,288 | A | 6/1962 | Edlen et al. |
| 3,184,706 | A | 5/1965 | Atkins |
| 3,196,382 | A | 7/1965 | Morello, Jr. |
| 3,206,540 | A | 9/1965 | Cohen |
| 3,245,027 | A | 4/1966 | Ziegler, Jr. |
| 3,275,913 | A | 9/1966 | Blanchard et al. |
| 3,275,970 | A | 9/1966 | Johanson et al. |
| 3,292,136 | A | 12/1966 | Somerset |
| 3,295,076 | A | 12/1966 | Kraus |
| 3,297,979 | A | 1/1967 | O'Keefe et al. |
| 3,320,575 | A | 5/1967 | Brown et al. |
| 3,336,562 | A | 8/1967 | McCormick et al. |
| 3,350,677 | A | 10/1967 | Daum |
| 3,355,698 | A | 11/1967 | Keller |
| 3,373,243 | A | 3/1968 | Janowiak et al. |
| 3,384,703 | A | 5/1968 | Forney, Jr. et al. |
| 3,406,373 | A | 10/1968 | Forney, Jr. et al. |
| 3,448,430 | A | 6/1969 | Kelly |
| 3,465,281 | A | 9/1969 | Florer |
| 3,467,940 | A | 9/1969 | Wallo |
| 3,475,545 | A | 10/1969 | Stark et al. |
| 3,498,647 | A | 3/1970 | Schroder |
| 3,526,871 | A | 9/1970 | Hobart |
| 3,533,051 | A | 10/1970 | Ziegler, Jr. |
| 3,537,065 | A | 10/1970 | Winston |
| 3,538,464 | A | 11/1970 | Walsh |
| 3,544,705 | A | 12/1970 | Winston |
| 3,551,882 | A | 12/1970 | O'Keefe |
| 3,564,487 | A | 2/1971 | Upstone et al. |
| 3,573,677 | A | 4/1971 | Detar |
| 3,579,155 | A | 5/1971 | Tuchto |
| 3,591,208 | A | 7/1971 | Nicolaus |
| 3,594,694 | A | 7/1971 | Clark |
| 3,613,050 | A | 10/1971 | Andrews |
| 3,629,792 | A | 12/1971 | Dorrell |
| 3,633,150 | A | 1/1972 | Swartz |
| 3,633,944 | A | 1/1972 | Hamburg |
| 3,644,874 | A | 2/1972 | Hutter |
| 3,646,502 | A | 2/1972 | Hutter et al. |
| 3,663,926 | A | 5/1972 | Brandt |
| 3,668,612 | A | 6/1972 | Nepovim |
| 3,669,472 | A | 6/1972 | Nadsady |
| 3,671,922 | A | 6/1972 | Zerlin et al. |
| 3,684,321 | A | 8/1972 | Hundhausen et al. |
| 3,686,623 | A | 8/1972 | Nijman |
| 3,694,792 | A | 9/1972 | Wallo |
| 3,710,005 | A | 1/1973 | French |
| 3,721,869 | A | 3/1973 | Paoli |
| 3,743,979 | A | 7/1973 | Schor |
| 3,745,514 | A | 7/1973 | Brishka |
| 3,778,535 | A | 12/1973 | Forney, Jr. |
| 3,781,762 | A | 12/1973 | Quackenbush |
| 3,808,580 | A | 4/1974 | Johnson |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,870,978 | A | 3/1975 | Dreyer |
| 3,879,102 | A | 4/1975 | Horak |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,953,098 | A | 4/1976 | Avery et al. |
| 3,961,294 | A | 6/1976 | Hollyday |
| 3,963,320 | A | 6/1976 | Spinner |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,012,105 | A | 3/1977 | Biddle |
| 4,017,139 | A | 4/1977 | Nelson |
| 4,046,451 | A | 9/1977 | Juds et al. |
| 4,051,447 | A | 9/1977 | Heckman, Jr. et al. |
| 4,053,200 | A | 10/1977 | Pugner |
| 4,059,330 | A | 11/1977 | Shirey |
| 4,093,335 | A | 6/1978 | Schwartz et al. |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,156,554 | A | 5/1979 | Aujla |
| 4,165,911 | A | 8/1979 | Laudig |
| 4,168,921 | A | 9/1979 | Blanchard |
| 4,172,385 | A | 10/1979 | Cristensen |
| 4,173,385 | A | 11/1979 | Fenn et al. |
| 4,187,481 | A | 2/1980 | Boutros |
| 4,191,408 | A | 3/1980 | Acker |
| 4,225,162 | A | 9/1980 | Dola |
| 4,227,765 | A | 10/1980 | Neumann et al. |
| 4,235,461 | A | 11/1980 | Normark |
| 4,250,348 | A | 2/1981 | Kitagawa |
| 4,255,011 | A | 3/1981 | Davis et al. |
| 4,258,943 | A | 3/1981 | Vogt et al. |
| 4,280,749 | A | 7/1981 | Hemmer |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,400,050 | A | 8/1983 | Hayward |
| 4,406,483 | A | 9/1983 | Perlman |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,456,323 | A | 6/1984 | Pitcher et al. |
| 4,462,653 | A | 7/1984 | Flederbach et al. |
| 4,464,000 | A | 8/1984 | Werth et al. |
| 4,484,792 | A | 11/1984 | Tengler et al. |
| 4,515,427 | A | 5/1985 | Smit |
| 4,533,191 | A | 8/1985 | Blackwood |
| 4,540,231 | A | 9/1985 | Forney, Jr. |
| 4,545,633 | A | 10/1985 | McGeary |
| 4,545,637 | A | 10/1985 | Bosshard et al. |
| 4,557,546 | A | 12/1985 | Dreyer |
| 4,561,716 | A | 12/1985 | Acke |
| 4,575,274 | A | 3/1986 | Hayward |
| 4,583,811 | A | 4/1986 | McMills |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,597,620 | A | 7/1986 | Lindner et al. |
| 4,598,961 | A | 7/1986 | Cohen |
| 4,600,263 | A | 7/1986 | DeChamp et al. |
| 4,613,119 | A | 9/1986 | Hardtke |
| 4,614,390 | A | 9/1986 | Baker |
| 4,632,487 | A | 12/1986 | Wargula |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,688,876 | A | 8/1987 | Morelli |
| 4,688,878 | A | 8/1987 | Cohen et al. |
| 4,691,976 | A | 9/1987 | Cowen |

4,703,987 A 11/1987 Gallusser et al.
4,703,988 A 11/1987 Raux et al.
4,717,355 A 1/1988 Mattis
4,738,009 A 4/1988 Down et al.
4,746,305 A 5/1988 Nomura
4,747,786 A 5/1988 Hayashi et al.
4,755,152 A 7/1988 Elliot et al.
4,759,729 A 7/1988 Kemppainen et al.
4,761,146 A 8/1988 Sohoel
4,772,222 A 9/1988 Laudig et al.
4,777,669 A 10/1988 Rogus
4,789,355 A 12/1988 Lee
4,793,821 A 12/1988 Fowler et al.
4,806,116 A 2/1989 Ackerman
4,808,128 A 2/1989 Werth
4,813,886 A 3/1989 Roos et al.
4,820,185 A 4/1989 Moulin
4,824,400 A 4/1989 Spinner
4,834,675 A 5/1989 Samchisen
4,854,893 A 8/1989 Morris
4,857,014 A 8/1989 Alf et al.
4,869,679 A 9/1989 Szegda
4,874,331 A 10/1989 Iverson
4,878,697 A 11/1989 Henry
4,892,275 A 1/1990 Szegda
4,902,246 A 2/1990 Samchisen
4,906,207 A 3/1990 Banning et al.
4,915,651 A 4/1990 Bout
4,923,412 A 5/1990 Morris
4,925,403 A 5/1990 Zorzy
4,927,385 A 5/1990 Cheng
4,929,188 A 5/1990 Lionetto et al.
4,941,846 A 7/1990 Guimond et al.
4,952,174 A 8/1990 Sucht et al.
4,957,456 A 9/1990 Olson et al.
4,973,265 A 11/1990 Heeren
4,979,911 A 12/1990 Spencer
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,021,010 A 6/1991 Wright
5,024,606 A 6/1991 Min-Hwa
5,037,328 A 8/1991 Karlovich
5,062,804 A 11/1991 Jamet et al.
5,066,248 A 11/1991 Gaver, Jr. et al.
5,073,129 A 12/1991 Szegda
5,083,943 A 1/1992 Tarrant
5,100,341 A 3/1992 Czyz et al.
5,120,260 A 6/1992 Jackson
5,127,853 A 7/1992 McMills et al.
5,131,862 A 7/1992 Gershfeld
5,141,451 A 8/1992 Down
5,154,636 A 10/1992 Vaccaro et al.
5,161,993 A 11/1992 Leibfried, Jr.
5,192,219 A 3/1993 Fowler et al.
5,195,906 A 3/1993 Szegda
5,205,761 A 4/1993 Nilsson
5,207,602 A 5/1993 McMills et al.
5,217,391 A 6/1993 Fisher, Jr.
5,217,393 A 6/1993 Del Negro et al.
5,269,701 A 12/1993 Leibfried, Jr.
5,280,254 A 1/1994 Hunter et al.
5,281,167 A 1/1994 Le et al.
5,283,853 A 2/1994 Szegda
5,284,449 A 2/1994 Vaccaro
5,316,494 A 5/1994 Flanagan et al.
5,316,499 A 5/1994 Scannelli et al.
5,318,459 A 6/1994 Shields
5,338,225 A 8/1994 Jacobsen et al.
5,342,218 A 8/1994 McMills et al.
5,354,217 A 10/1994 Gabel et al.
5,371,819 A 12/1994 Szegda
5,371,821 A 12/1994 Szegda
5,371,827 A 12/1994 Szegda
5,393,244 A 2/1995 Szegda
5,409,398 A 4/1995 Chadbourne et al.
5,417,588 A 5/1995 Olson et al.
5,431,583 A 7/1995 Szegda
5,435,745 A 7/1995 Booth
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,490,033 A 2/1996 Cronin
5,494,454 A 2/1996 Johnsen
5,496,076 A 3/1996 Lin
5,501,616 A 3/1996 Holliday
5,525,076 A 6/1996 Down
5,542,861 A 8/1996 Anhalt et al.
5,548,088 A 8/1996 Gray et al.
5,550,521 A 8/1996 Bernaud et al.
5,571,028 A 11/1996 Szegda
5,586,910 A 12/1996 Del Negro et al.
5,595,502 A 1/1997 Allison
5,598,132 A 1/1997 Stabile
5,607,325 A 3/1997 Toma
5,620,339 A 4/1997 Gray et al.
5,632,651 A 5/1997 Szegda
5,651,699 A 7/1997 Holliday
5,653,605 A 8/1997 Woehl et al.
5,667,405 A 9/1997 Holliday
5,683,263 A 11/1997 Hsu
5,690,503 A 11/1997 Konda et al.
5,695,365 A 12/1997 Kennedy et al.
5,702,262 A 12/1997 Brown et al.
5,702,263 A 12/1997 Baumann et al.
5,769,652 A 6/1998 Wider
5,775,927 A 7/1998 Wider
5,879,191 A 3/1999 Burris
5,882,226 A 3/1999 Bell et al.
5,956,365 A 9/1999 Haissig
5,967,852 A 10/1999 Follingstad et al.
5,975,949 A 11/1999 Holliday et al.
5,975,951 A 11/1999 Burris et al.
5,997,350 A 12/1999 Burris et al.
6,019,636 A 2/2000 Langham
6,032,358 A 3/2000 Wild
6,042,422 A 3/2000 Youtsey
6,089,903 A 7/2000 Stafford Gray et al.
6,089,912 A 7/2000 Tallis et al.
6,089,913 A 7/2000 Holliday
6,106,314 A 8/2000 McLean et al.
6,123,581 A 9/2000 Stabile et al.
6,146,197 A 11/2000 Holliday et al.
6,153,830 A 11/2000 Montena
6,168,211 B1 1/2001 Schorn-Gilson
6,210,222 B1 4/2001 Langham et al.
6,217,383 B1 4/2001 Holland et al.
RE37,153 E 5/2001 Henszey et al.
6,241,553 B1 6/2001 Hsia
6,261,126 B1 7/2001 Stirling
6,344,736 B1 2/2002 Kerrigan et al.
6,358,077 B1 3/2002 Young
6,390,825 B1 5/2002 Handley et al.
D458,904 S 6/2002 Montena
D460,739 S 7/2002 Fox
D460,740 S 7/2002 Montena
D460,946 S 7/2002 Montena
D460,947 S 7/2002 Montena
D460,948 S 7/2002 Montena
D461,166 S 8/2002 Montena
D461,167 S 8/2002 Montena
D461,778 S 8/2002 Fox
D462,058 S 8/2002 Montena
D462,060 S 8/2002 Fox
D462,327 S 9/2002 Montena
6,478,618 B2 * 11/2002 Wong ..... 439/585
6,491,546 B1 12/2002 Perry
D468,696 S 1/2003 Montena
6,558,194 B2 5/2003 Montena
6,561,841 B2 5/2003 Norwood et al.
6,619,876 B2 * 9/2003 Vaitkus et al. ..... 403/349
6,621,386 B2 9/2003 Drackner et al.

| | | | | |
|---|---|---|---|---|
| 6,692,285 | B2 * | 2/2004 | Islam | 439/352 |
| 6,712,631 | B1 | 3/2004 | Youtsey | |
| 6,716,062 | B1 | 4/2004 | Palinkas et al. | |
| 6,733,337 | B2 | 5/2004 | Kodaira | |
| 6,767,248 | B1 | 7/2004 | Hung | |
| 6,805,584 | B1 | 10/2004 | Chen | |
| 6,817,896 | B2 | 11/2004 | Derenthal | |
| 6,830,479 | B2 | 12/2004 | Holliday | |
| 6,848,940 | B2 | 2/2005 | Montena | |
| 6,910,910 | B2 | 6/2005 | Cairns | |
| 6,921,283 | B2 | 7/2005 | Zahlit et al. | |
| 6,939,169 | B2 | 9/2005 | Islam et al. | |
| 7,114,990 | B2 | 10/2006 | Bence et al. | |
| 7,189,097 | B2 | 3/2007 | Benham | |
| 7,192,308 | B2 | 3/2007 | Rodrigues et al. | |
| 7,473,128 | B2 * | 1/2009 | Montena | 439/584 |
| 7,566,236 | B2 | 7/2009 | Malloy et al. | |
| 7,587,244 | B2 | 9/2009 | Olbertz | |
| 7,753,705 | B2 | 7/2010 | Montena | |
| 7,828,595 | B2 | 11/2010 | Mathews | |
| 7,833,053 | B2 | 11/2010 | Mathews | |
| 2002/0013088 | A1 | 1/2002 | Rodrigues et al. | |
| 2004/0048514 | A1 | 3/2004 | Kodaira | |
| 2004/0077215 | A1 | 4/2004 | Palinkas et al. | |
| 2004/0102089 | A1 | 5/2004 | Chee | |
| 2004/0224552 | A1 * | 11/2004 | Hagmann et al. | 439/461 |
| 2004/0229504 | A1 | 11/2004 | Liu | |
| 2005/0042919 | A1 | 2/2005 | Montena | |
| 2005/0164553 | A1 * | 7/2005 | Montena | 439/578 |
| 2005/0208827 | A1 | 9/2005 | Burris et al. | |
| 2006/0110977 | A1 | 5/2006 | Matthews | |
| 2008/0102696 | A1 | 5/2008 | Montena | |
| 2008/0113554 | A1 * | 5/2008 | Montena | 439/585 |
| 2008/0311790 | A1 | 12/2008 | Malloy et al. | |
| 2010/0081321 | A1 | 4/2010 | Malloy et al. | |
| 2010/0081322 | A1 | 4/2010 | Malloy et al. | |

FOREIGN PATENT DOCUMENTS

| | | | |
|---|---|---|---|
| DE | 47931 | | 10/1888 |
| DE | 1 117 687 | | 11/1961 |
| DE | 1 515 398 | | 11/1962 |
| DE | 1 191 880 | | 4/1965 |
| DE | 2 221 936 | | 5/1972 |
| DE | 2 225 764 | | 5/1972 |
| DE | 2 261 973 | | 12/1972 |
| DE | 102289 | | 7/1987 |
| DE | 41 28 551 | A1 | 3/1992 |
| EP | 0 072 104 | | 2/1983 |
| EP | 0 116 157 | | 8/1984 |
| EP | 0 167 738 | | 1/1986 |
| EP | 0 265 276 | B1 | 4/1988 |
| FR | 2 232 846 | | 6/1974 |
| FR | 2 234 680 | | 6/1974 |
| FR | 2 462 798 | | 2/1980 |
| FR | 4 494 508 | | 5/1982 |
| FR | 2 524 722 | | 10/1983 |
| GB | 589697 | | 3/1945 |
| GB | 1087228 | | 10/1967 |
| GB | 1 270 846 | | 4/1972 |
| GB | 2 019 665 | A | 10/1979 |
| GB | 2 079 549 | A | 1/1982 |
| GB | 32 11 008 | A1 | 10/1983 |
| GB | 2 331 634 | A | 5/1999 |
| JP | 03071571 | | 3/1991 |
| JP | 03-280369 | | 12/1991 |
| JP | 10-228948 | | 8/1998 |
| JP | 2002075556 | | 3/2002 |
| WO | WO 93/24973 | | 12/1993 |
| WO | WO 96/08854 | | 3/1996 |
| WO | WO 01/86756 | A1 | 11/2001 |

OTHER PUBLICATIONS

Office Action for U.S. Appl. No. 12/568,149, mail date May 12, 2011, 8 pages.
Office Action for U.S. Appl. No. 12/568,160, mail date Jul. 22, 2010, 9 pages.
Office Action for U.S. Appl. No. 12/568,160, mail date Sep. 8, 2010, 10 pages.
Response to Office Action for U.S. Appl. No. 12/568,160, filed Aug. 23, 2010, 3 pages.
Response to Office Action for U.S. Appl. No. 12/568,160, filed Mar. 7, 2011, 37 pages.

* cited by examiner

CABLE CONNECTOR

RELATED APPLICATIONS

This application claims priority under 35 U.S.C. §119 based on U.S. Provisional Patent Application Nos. 61/101,185 filed Sep. 30, 2008, 61/101,191, filed Sep. 30, 2008, 61/155,246, filed Feb. 25, 2009, 61/155,249, filed Feb. 25, 2009, 61/155,250, filed Feb. 25, 2009, 61/155,252, filed Feb. 25, 2009, 61/155,289, filed Feb. 25, 2009, 61/155,297, filed Feb. 25, 2009, 61/175,613, filed May 5, 2009, and 61/242,884, filed Sep. 16, 2009, the disclosures of which are all hereby incorporated by reference herein.

This application is also related to co-pending U.S. patent application Ser. No. 12/568,160, entitled "Cable Connector," filed, Sep. 28, 2009, and U.S. patent application Ser. No. 12/568,149, entitled "Cable Connector," filed Sep. 28, 2009, the disclosures of which are both hereby incorporated by reference herein.

BACKGROUND INFORMATION

Connectors are used to connect coaxial cables to various electronic devices, such as televisions, antennas, set-top boxes, satellite television receivers, audio equipment, or other electronic equipment. Conventional coaxial connectors generally include a connector body having an annular collar for accommodating a coaxial cable, an annular nut rotatably coupled to the collar for providing mechanical attachment of the connector to an external device and an annular post interposed between the collar and the nut. The annular collar that receives the coaxial cable includes a cable receiving end for insertably receiving a coaxial cable and, at the opposite end of the connector body, the annular nut includes an internally threaded end that permits screw threaded attachment of the body to an external device.

This type of coaxial connector also typically includes a locking sleeve to secure the cable within the body of the coaxial connector. The locking sleeve, which is typically formed of a resilient plastic, is securable to the connector body to secure the coaxial connector thereto. In this regard, the connector body typically includes some form of structure to cooperatively engage the locking sleeve. Such structure may include one or more recesses or detents formed on an inner annular surface of the connector body, which engages cooperating structure formed on an outer surface of the locking sleeve.

Conventional coaxial cables typically include a center conductor surrounded by an insulator. A conductive foil is disposed over the insulator and a braided conductive shield surrounds the foil-covered insulator. An outer insulative jacket surrounds the shield. In order to prepare the coaxial cable for termination, the outer jacket is stripped back exposing a portion of the braided conductive shield. The exposed braided conductive shield is folded back over the jacket. A portion of the insulator covered by the conductive foil extends outwardly from the jacket and a portion of the center conductor extends outwardly from within the insulator.

Upon assembly, a coaxial cable is inserted into the cable receiving end of the connector body and the annular post is forced between the foil covered insulator and the conductive shield of the cable. In this regard, the post is typically provided with a radially enlarged barb to facilitate expansion of the cable jacket. The locking sleeve is then moved axially into the connector body to clamp the cable jacket against the post barb providing both cable retention and a water-tight seal around the cable jacket. The connector can then be attached to an external device by tightening the internally threaded nut to an externally threaded terminal or port of the external device.

The Society of Cable Telecommunication Engineers (SCTE) provides values for the amount of torque recommended for connecting such coaxial cable connectors to various external devices. Indeed, most cable television (CATV), multiple system operator (MSO), satellite and telecommunication providers also require their installers to apply a torque requirement of 25 to 30 in/lb to secure the fittings against the interface (reference plane). The torque requirement prevents loss of signals (egress) or introduction of unwanted signals (ingress) between the two mating surfaces of the male and female connectors, known in the field as the reference plane.

DETAILED DESCRIPTION OF PREFERRED EMBODIMENTS

The following detailed description refers to the accompanying drawings. The same reference numbers in different drawings may identify the same or similar elements. Also, the following detailed description does not limit the invention.

A large number of home coaxial cable installations are often done by "do-it yourself" lay-persons who may not be familiar with such torque standards. In these cases, the installer will typically hand-tighten the coaxial cable connectors instead of using a tool, which can result in the connectors not being properly seated, either upon initial installation, or after a period of use. Upon immediately receiving a poor signal, the customer typically calls the CATV, MSO, satellite or telecommunication provider to request repair service. Obviously, this is a cost concern for the CATV, MSO, satellite and telecommunication providers, who then have to send a repair technician to the customer's home.

Moreover, even when tightened according to the proper torque requirements, another problem with such prior art connectors is the connector's tendency over time to become disconnected from the external device to which it is connected, due to forces such as vibrations, heat expansion, etc. Specifically, the internally threaded nut for providing mechanical attachment of the connector to an external device has a tendency to back-off or loosen itself from the threaded port connection of the external device over time. Once the connector becomes sufficiently loosened, electrical connection between the coaxial cable and the external device is broken, resulting in a failed condition. Embodiments described herein provide a connector with a biasing element that helps prevent the connector from being loosened, thereby helping to avoid a failed condition.

Figure 1:
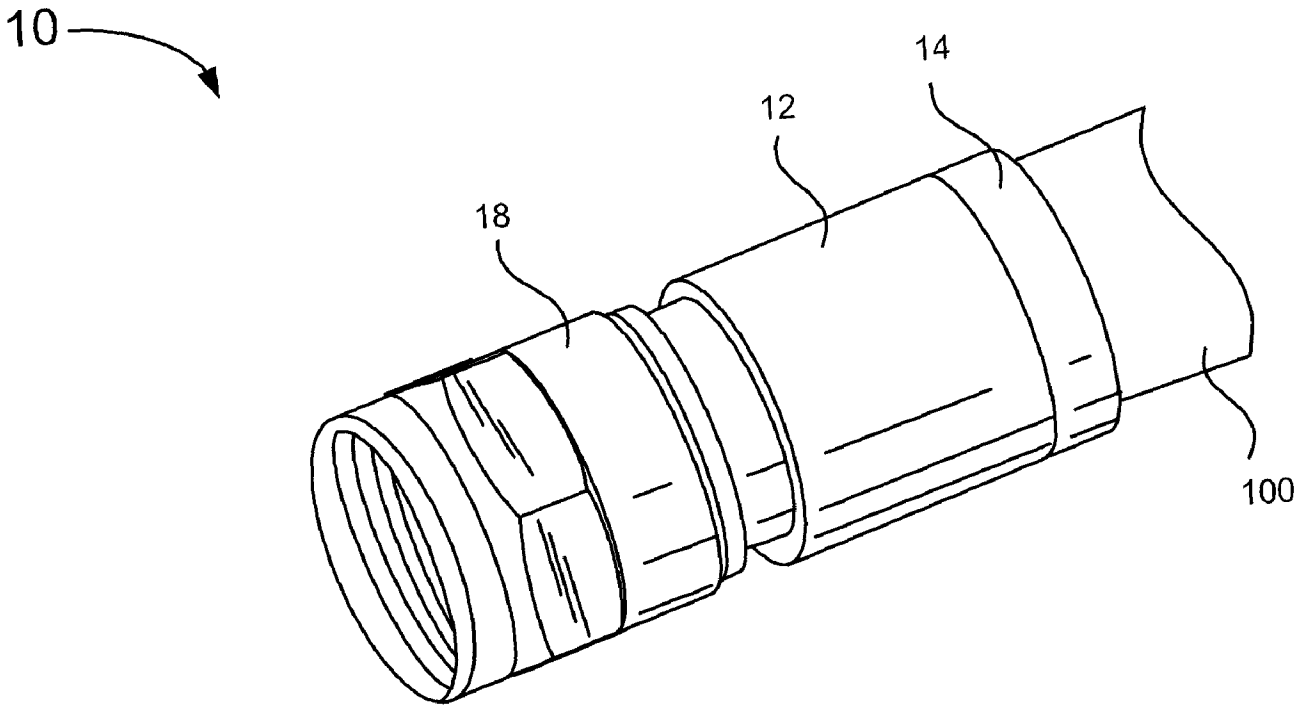
FIG. 1 is an isometric view of an exemplary embodiment of a cable connector.
Figure 2:
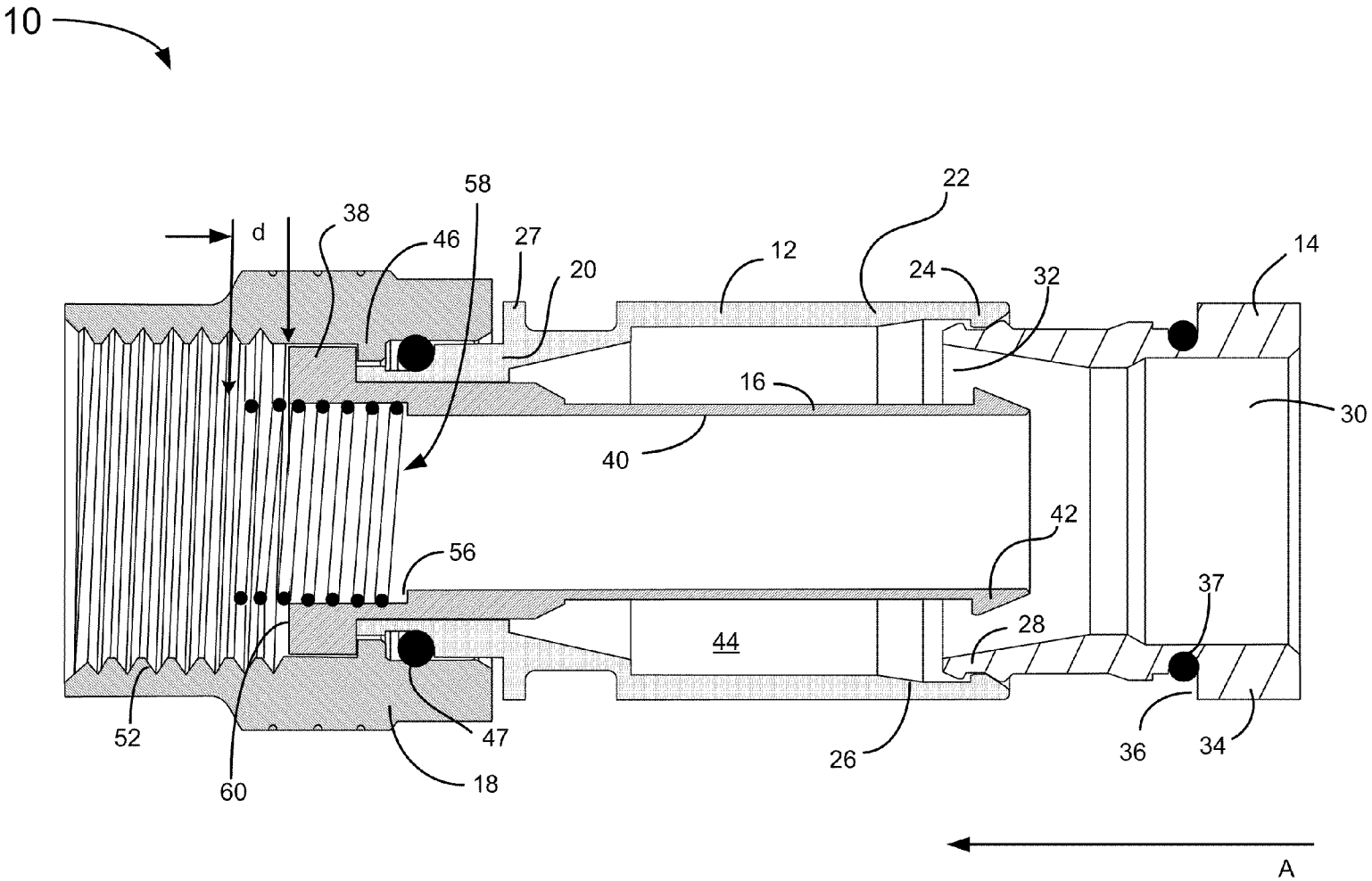
FIG. 2 is an exemplary cross-sectional view of the coaxial cable connector of FIG. 1 in an unconnected configuration.
Figure 3:
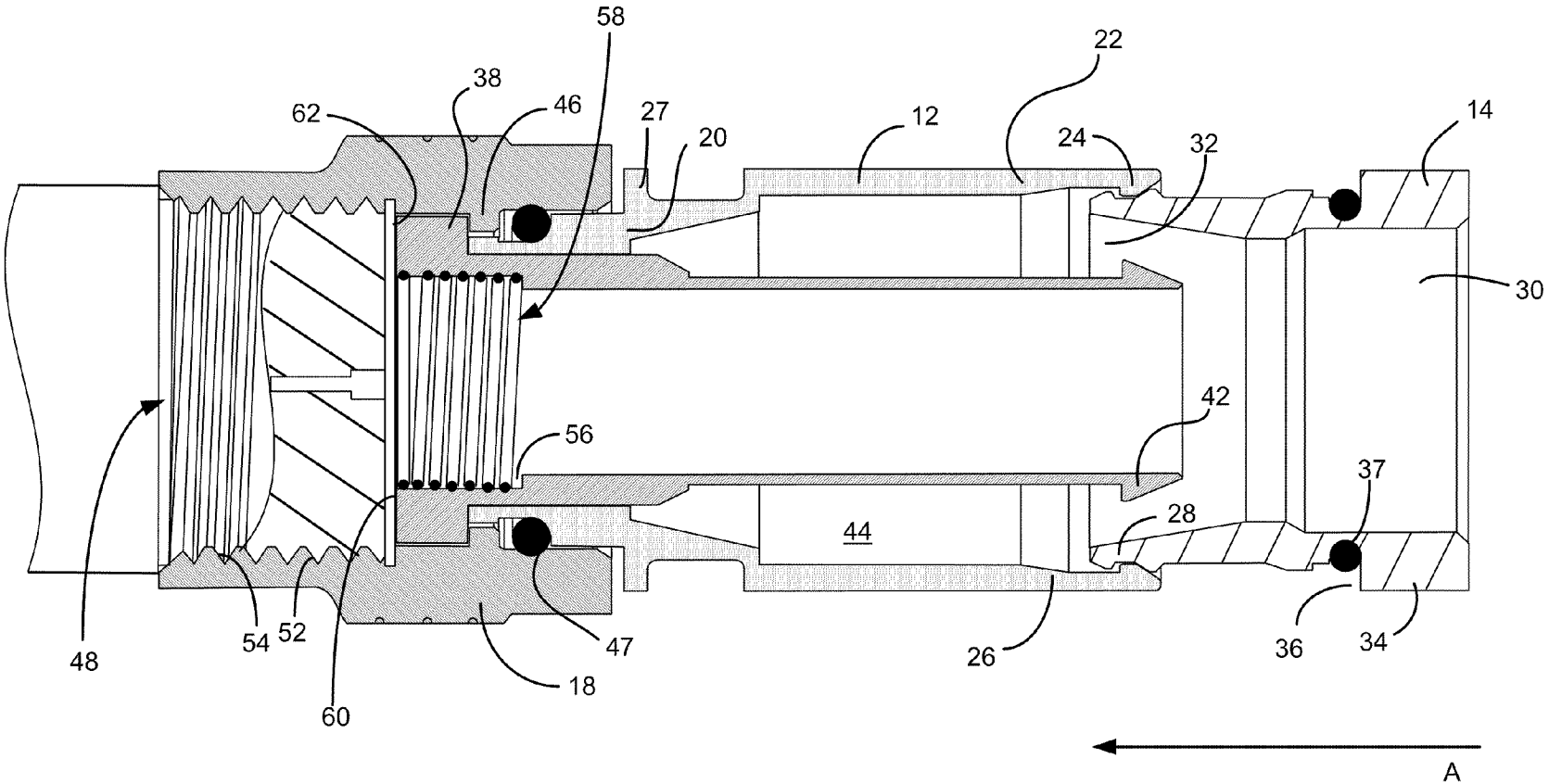
FIG. 3 is an exemplary cross-sectional view of the coaxial cable connector of FIG. 1 in a connected configuration.

FIGS. 1-3 depict an exemplary coaxial cable connector consistent with embodiments described herein. Referring to FIGS. 1 and 2, coaxial cable connector 10 may include a connector body 12, a locking sleeve 14, an annular post 16 and a rotatable nut 18.

In one implementation, connector body 12, also referred to as collar 12, may include an elongated, generally cylindrical member, which may be made from plastic, metal or some other material or combination of materials. Connector body 12 may include a forward end 20 operatively coupled to annular post 16 and rotatable nut 18. Connector body 12 may also include a cable receiving end 22 located opposite forward end 20. Cable receiving end 22 may be configured to insertably receive locking sleeve 14, as well as a prepared end of a coaxial cable, such as coaxial cable 100 (shown in FIG. 1), in the forward direction as shown by arrow A in FIG. 2. Cable receiving end 22 of the connector body 12 may further include an inner sleeve engagement surface 24 for coupling with locking sleeve 14. In some implementations, inner sleeve engagement surface 24 is preferably formed with a groove or recess 26, which cooperates with mating detent structure 28 provided on the outer surface of locking sleeve 14.

Locking sleeve 14 may include a substantially tubular member having a rearward cable receiving end 30 and an opposite forward connector insertion end 32, which is movably coupled to the inner sleeve engagement surface 24 of connector body 12. As mentioned above, the outer cylindrical surface of locking sleeve 14 may include one or more ridges or projections 28, which cooperate with the groove or recess 26 formed in the inner sleeve engagement surface 24 of the connector body 12 to allow for the movable connection of locking sleeve 14 to connector body 12, such that locking sleeve 14 is lockingly axially moveable along the direction of arrow A toward the forward end 20 of the connector body 12 from a first position, as shown, for example, in FIG. 2, to a second axially advanced position (shown in FIG. 1). When in the first position, locking sleeve 14 may be loosely retained in connector 10. When in the second position, locking sleeve 14 may be secured within connector 10.

In some additional implementations, locking sleeve 14 may include a flanged head portion 34 disposed at the rearward cable receiving end 30 of locking sleeve 14. Head portion 34 may have an outer diameter that is larger than an inner diameter of connector body 12 and may further include a forward facing perpendicular wall 36, which serves as an abutment surface against which the rearward end of connector body 12 to prevent further insertion of locking sleeve 14 into body 12. A resilient, sealing O-ring 37 may be provided at forward facing perpendicular wall 36 to provide a substantially water-tight seal between locking sleeve 14 and connector body 12 upon insertion of the locking sleeve 14 within connector body 12 and advancement from the first position (FIG. 2) to the second position (FIG. 1).

In some implementations, locking sleeve 14 may be detachably removed from connector 10, e.g., during shipment, etc., by, for example, snappingly removing projections 28 from groove/recess 26. Prior to installation, locking sleeve 14 may be reattached to connector body 12 in the manner described above.

As discussed above, connector 10 may further include an annular post 16 coupled to the forward end 20 of connector body 12. As illustrated in FIGS. 2 and 3, annular post 16 may include a flanged base portion 38 at its forward end for securing annular post 16 within rotatable nut 18. Annular post 16 may also include an annular tubular extension 40 extending rearwardly within body 12 and terminating adjacent the rearward end 22 of connector body 12. In one embodiment, the rearward end of tubular extension 40 may include a radially outwardly extending ramped flange portion or "barb" 42 to enhance compression of the outer jacket of the coaxial cable (e.g., coaxial cable 100) to secure the cable within connector 10. Tubular extension 40 of annular post 16, locking sleeve 14 and connector body 12 together define an annular chamber 44 for accommodating the jacket and shield of the inserted coaxial cable.

As illustrated in FIGS. 1-3, nut 18 may be rotatably coupled to forward end 20 of connector body 12. Nut 18 may include any number of attaching mechanisms, such as a hex nut, a knurled nut, a wing nut, or any other known attaching mechanisms, and may be rotatably coupled to connector body 12 for providing mechanical attachment of the connector 10 to an external device via a threaded relationship. For example, nut 18 may include internal threads 52 that mate with external threads of an external connector, as described in more detail below. As illustrated in FIGS. 2 and 3, annular nut 18 may include an annular flange 46. Annular flange 46 and flange 27 located in forward end 20 of connector 10 are configured to fix nut 18 axially relative to annular post 16 and connector body 12. In one implementation, a resilient sealing O-ring 47 may be positioned in nut 18 to provide a water resistant seal between connector body 12, annular post 16 and nut 18.

Connector 10 may be supplied in the assembled condition, as shown in FIG. 2, in which locking sleeve 14 is pre-installed inside rearward cable receiving end 22 of connector body 12. In such an assembled condition, coaxial cable 100 may be inserted through rearward cable receiving end 30 of locking sleeve 14 to engage annular post 16 of connector 10 in the manner described above. In other implementations, locking sleeve 14 may be first slipped over the end of coaxial cable 100 and coaxial cable 100 (together with locking sleeve 14) may be subsequently inserted into rearward end 22 of connector body 12.

In either case, once the prepared end of a coaxial cable is inserted into connector body 12 so that the cable jacket is separated from the insulator by the sharp edge of annular post 16, locking sleeve 14 may be moved axially forward in the direction of arrow A from the first position (shown in FIGS. 2 and 3) to the second position (shown in FIG. 1). In some implementations, advancing locking sleeve 14 from the first position to the second position may be accomplished with a suitable compression tool. As locking sleeve 14 is moved axially forward, the cable jacket is compressed within annular chamber 44 to secure the cable in connector 10. Once the cable is secured, connector 10 is ready for attachment to a port connector 48 (illustrated in FIG. 3), such as a female F-81 connector, of an external device.

As illustrated in FIG. 3, port connector 48 may include a substantially cylindrical body that has external threads 54 that match internal threads 52 of nut 18. As will be discussed in detail below, retention force between annular nut 18 and port connector 48 may be enhanced by providing a substantially constant load force on the port connector 48. This constant load force enables connector 10 and port connector 48 to maintain signal contact should nut 18 become slightly loosened from port connector 48.

In an exemplary implementation, to provide this load force, flanged base portion 38 of annular post 16 may be configured to include an internal annular notch for retaining a biasing element. For example, as illustrated in FIGS. 2 and 3, flanged base portion 38 may include a step configuration or annular notch 56 formed on an inner surface thereof. The annular notch 56 may extend from a forward portion of annular post 16 to a front face 60 of annular post 16. In an exemplary embodiment, a biasing element 58 may be positioned within notch 56, as illustrated in FIG. 2.

In one implementation, biasing element 58 may include a coil spring that is made of a conductive, resilient material that is configured to provide a suitable biasing force between annular post 16 and rearward surface of port connector 48. The conductive nature of biasing element 58 may also enable effective transmission of electrical and radio frequency (RF) signals from annular post 16 to port connector 48, at varying degrees of insertion relative to port connector 48 and connector 10, as described in more detail below. In other implementations, biasing element 58 may include multiple coil springs, one or more wave springs (single or double wave), one or more conical spring washers (slotted or unslotted), one or more Belleville washers, or any other suitable biasing element, such as a conductive resilient component (e.g., a plastic or elastomeric member impregnated or injected with conductive particles), etc.

As discussed above, in one embodiment, biasing element 58 may include a coil spring. For example, biasing element 58 may be a coil spring made from wire having a 0.008 inch diameter. Alternatively, wires having any other diameter may be used to form biasing element 58. As illustrated in FIG. 3, biasing element 58 may have an overall width or diameter that is sized substantially similar to the diameter of annular notch 56. In one configuration, a forward edge of the front edge of the annular surface of notch 56 may be beveled or angled to facilitate insertion of biasing element 58 into annular notch 56. This may allow biasing element 58 to be easily press-fit and retained within annular notch 56.

In an initial, uncompressed state (as shown in FIG. 2), biasing element 58 may extend a length "d" beyond forward surface 60 of annular post 16. In one implementation, the length "d" may be approximately 0.05 inches. However, in other implementations, length d may be greater or smaller. Upon insertion of port connector 48 (e.g., via rotatable threaded engagement between threads 52 of connector 10 and threads 54 of port connector 48 as shown in FIG. 3), rearward surface 62 of port connector 48 may come into contact with biasing element 58. In a position of initial contact between port connector 48 and biasing element 58 (not shown in FIG. 3), rearward surface 62 of port connector 48 may be separated from forward surface 60 of annular post 16 by the distance "d." The conductive nature of biasing element 58 may enable effective transmission of electrical and RF signals from port connector 48 to annular post 16 even when separated by distance d, effectively increasing the reference plane of connector 10 with respect to port connector 48. In one implementation, the above-described configuration enables a functional gap or "clearance" between the reference planes, thereby enabling approximately 270 degrees or more of "back-off" rotation of annular nut 18 relative to port connector 48 while maintaining suitable passage of electrical and RF signals.

Continued insertion of port connector 48 into connector 10 may cause biasing element 58 to compress, thereby providing a load force between flanged base portion 38 and port connector 48 and decreasing the distance between rearward surface 62 of port connector 48 and forward surface 60 of annular post 16. For example, when nut 18 is tightened, biasing element 58 may be compressed such that the front face of biasing element 58 becomes flush with forward surface 60 of annular post 16, as illustrated in FIG. 3. The load force from compressed biasing element 58 (e.g., a coiled spring) may be transferred to threads 52 and 54, thereby facilitating constant tension between threads 52 and 54 and causing a decreased likelihood that port connector 48 becomes loosened from connector 10 due to external forces, such as vibrations, heating/cooling, etc. In addition, should nut 18 loosen and the rearward face 62 of port connector 48 begins to back away from the forward face 60 of annular post 16, the resilience of biasing element 58 will urge biasing element 58 to spring back to its initial form so that biasing element 58 will maintain electrical and RF contact with the rearward face 62 of port connector 48.

The above-described connector may pass electrical and RF signals typically found in CATV, satellite, closed circuit television (CCTV), voice over Internet protocol (VoIP), data, video, high speed Internet, etc., through the mating ports (about the connector reference planes). Providing a biasing element, as described above, may also provide power bonding grounding (i.e., help promote a safer bond connection per NEC® Article 250 when biasing element 58 is under linear compression) and RF shielding (Signal Ingress & Egress).

Upon installation, annular post 16 may be incorporated into a coaxial cable (e.g., coaxial cable 100) between the cable foil and the cable braid and may function to carry the RF signals propagated by the coaxial cable. In order to transfer the signals, post 16 makes contact with the reference plane of the mating connector (e.g., port connector 48). By retaining electrically conductive biasing element 58 in notch 56, biasing element 58 is able to ensure electrical and RF contact at the reference plane of port connector 48 at various distances with respect to annular post 16, while simultaneously requiring minimal additional structural elements with respect to connector 10 as compared to conventional connectors. Therefore, by providing biasing element 58 in the forward portion of flanged base portion 38, connector 10 may allow for up to 270 degrees or more of "back-off" rotation of the nut 18 with respect to port connector 48 without signal loss. In other words, biasing element 58 helps to maintain electrical and RF continuity even if annular nut 18 is partially loosened. As a result, maintaining electrical and RF contact between the coaxial cable connector 10 and port connector 48 may be significantly improved as compared with prior art connectors. Further, compression of biasing element 58 provides equal and opposite biasing forces between the internal threads 52 of nut 18 and the external threads 54 of port connector 48, thereby reducing the likelihood of back-off due to environmental factors.

Figure 4:
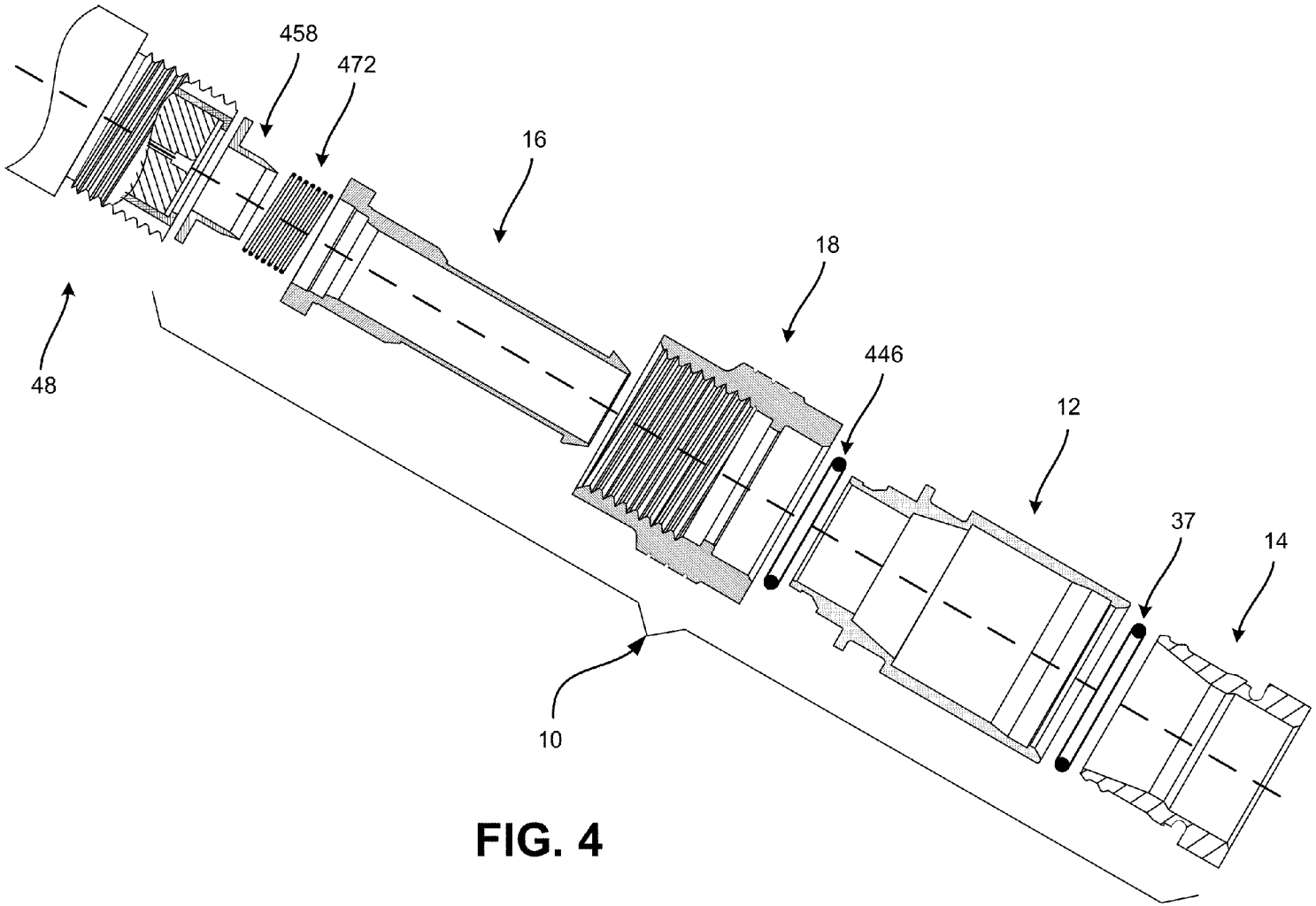
FIG. 4 is a cross-sectional view of the unassembled components of the coaxial cable connector of FIG. 1 in accordance with another exemplary embodiment.

Referring now to FIG. 4, a cross-sectional view of the unassembled components of coaxial cable connector 10 of FIG. 1 in accordance with an exemplary implementation is shown. FIG. 4 also shows a cross-sectional view of a port connector 48 to which connector 10 may be connected. As shown in FIG. 4, in addition to nut 18, body 12, and locking sleeve 14, connector 10 may also include a post 16, an end cap 458, a biasing element 472, an O-ring 446, and an O-ring 37.

Figure 5:
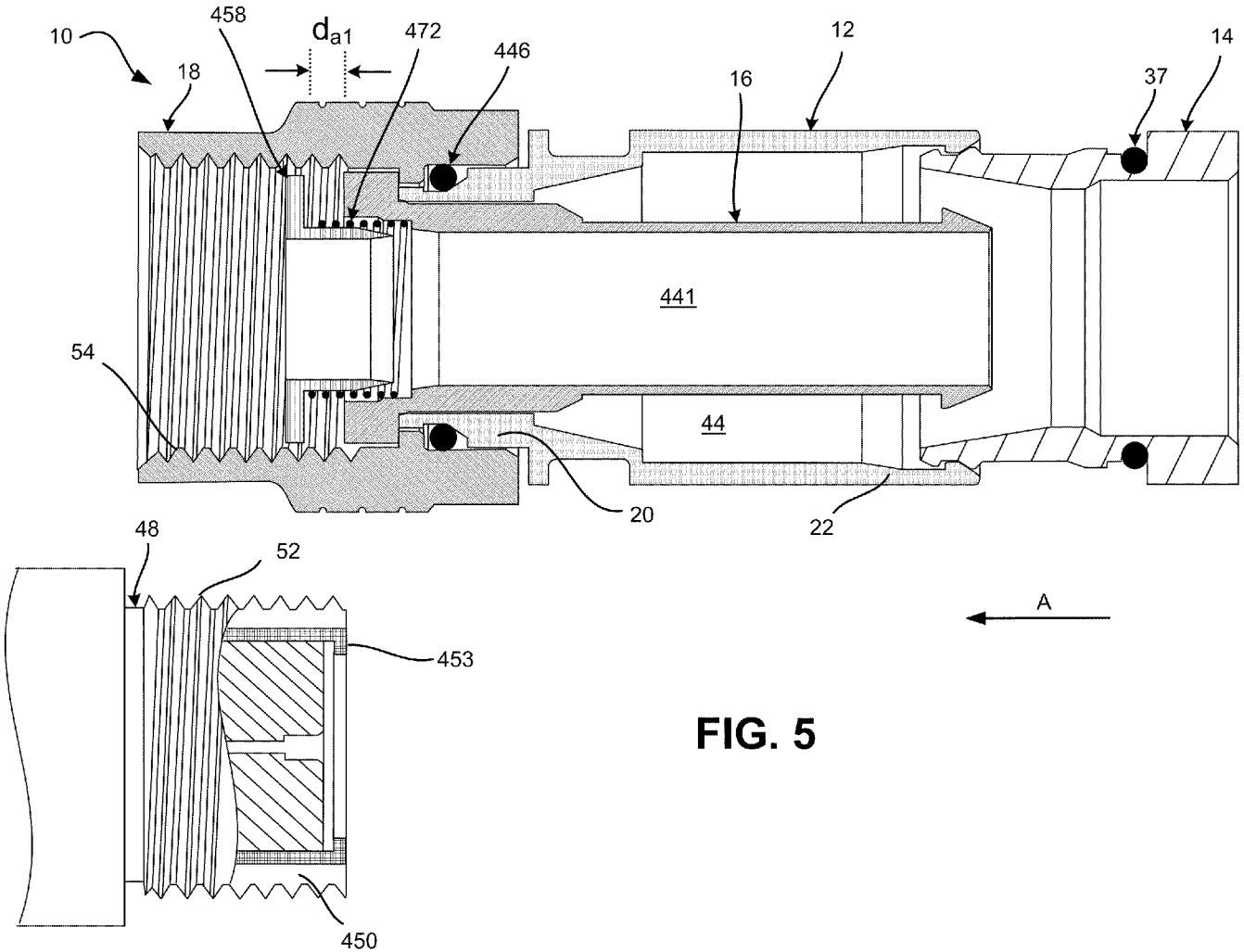
FIG. 5 is a cross-sectional view of the coaxial cable connector of FIG. 4 in an assembled, but unconnected configuration.
Figure 6A:
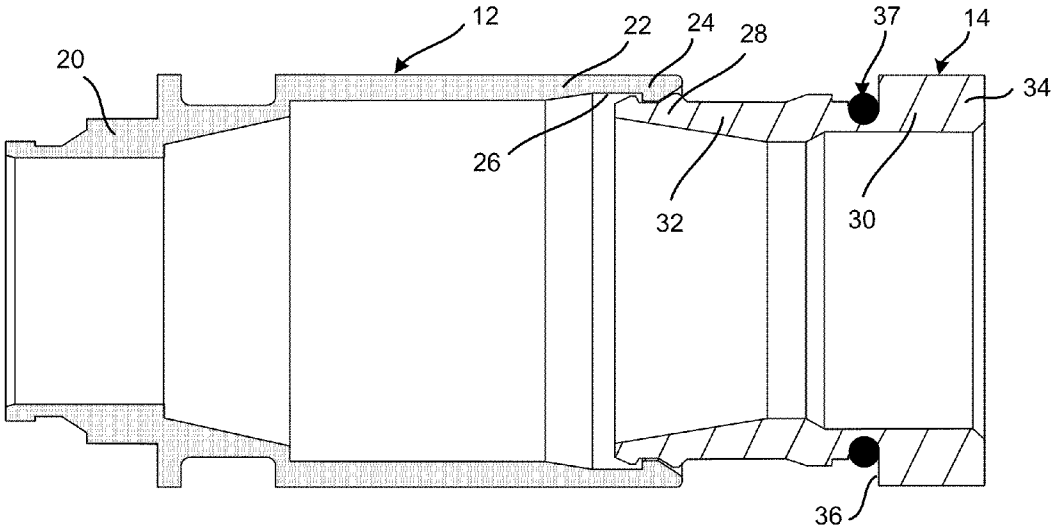
FIGS. 6A, 6B, 7A, 7B, and 8A through 8F are additional cross-sectional views of the unassembled components of the coaxial cable connector of FIGS. 1 and 4.

FIG. 5 is a cross-sectional view of coaxial cable connector 10 of FIGS. 1 and 4 in an assembled, but unconnected configuration, e.g., coaxial cable connector 10 is not connected to port connector 48, also shown in FIG. 5. As discussed above and shown in FIG. 5, connector body 12 may include an elongated, cylindrical member, which can be made from plastic, metal, or any suitable material or combination of materials. Cable receiving end 22 and locking sleeve 14 are described with respect to FIGS. 6A and 6B, which show additional cross-sectional views of connector body 12 and locking sleeve 14. For convenience, the direction opposite to direction A may be referred to as "rearward," but this opposite direction could be labeled as any direction. As mentioned above, the outer cylindrical surface of locking sleeve 14 may be configured to include a plurality of ridges or projections 28, which cooperate with groove or recess 26 formed in inner sleeve engagement surface 24 of the connector body 12 to allow for the movable connection of sleeve 14 into the connector body 12 such that locking sleeve 14 is axially moveable in forward direction A toward the forward end 20 of the connector body from a first position (e.g. shown in FIGS. 5 and 6A) to a second, axially advanced position (e.g., shown in FIGS. 1 and 6B). In the first position, locking sleeve 14 may be loosely retained by connector body 12. In the second position, locking sleeve 14 may be secured within connector body 12.

Figure 7A:
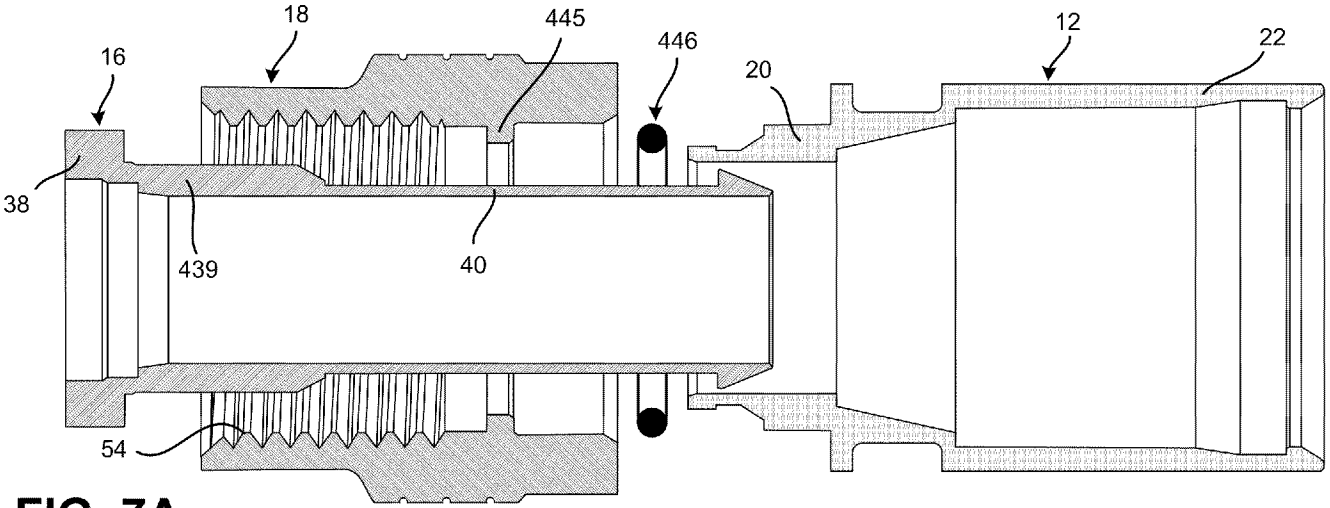
Figure 7B:
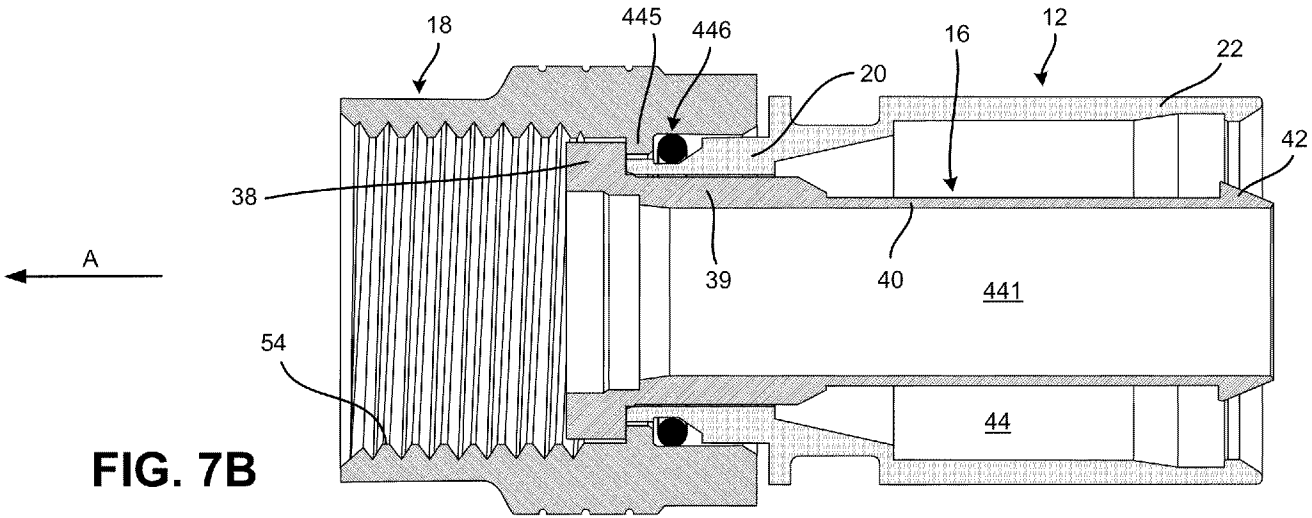

As also discussed above, connector 10 may further include annular post 16 coupled to forward end 20 of connector body 12. Forward end 20 of connector body 12, annular post 16, and nut 18 are described with respect to FIGS. 7A and 7B, which shows additional cross-sectional views of connector body 12, post 16, and nut 18. As illustrated in FIGS. 7A, and 7B, annular post 16 may include a flanged base portion 38 at its forward end for securing annular post 16 within annular nut 18, as shown in FIG. 5B. Annular post 16 may also include an annular tubular extension 40 extending rearwardly within body 12 and terminating adjacent rearward end 22 of connector body 12. Annular tubular extension 40 and flanged base portion 38 together define an inner chamber 441 (shown in FIGS. 5 and 7B) for receiving a center conductor and insulator of an inserted coaxial cable.

As shown in FIGS. 5 and 7B, annular nut 18 may be rotatably coupled to forward end 20 of connector body 12. Annular nut 18 may include any number of attaching mechanisms, such as that of a hex nut, a knurled nut, a wing nut, or any other known attaching means, and may be rotatably coupled to connector body 12 for providing mechanical attachment of connector 10 to an external device, e.g., port connector 48, via a threaded relationship. As illustrated in FIGS. 7A and 7B, nut 18 may include an annular flange 445 configured to fix nut 18 axially relative to annular post 16 and connector body 12. In one embodiment, O-ring 446 (e.g., a resilient sealing O-ring) may be positioned within annular nut 18 to provide a substantially water-resistant seal between connector body 12, annular post 16, and annular nut 18

Connector 10 may be supplied in the assembled condition, as shown in FIG. 5, in which (1) locking sleeve 14 is installed inside rearward cable receiving end 22 of connector body 12, and (2) post 16 is fit into body 12 to rotatably secure nut 18. In such an assembled condition, a coaxial cable may be inserted through rearward cable receiving end 30 of locking sleeve 14 to engage annular post 16 of connector 10, as described above. In other embodiments, locking sleeve 14 may first be slipped over the end of a coaxial cable and the cable (together with locking sleeve 14) may subsequently be inserted into rearward end 22 of connector body 12. As discussed above, in some implementations, locking sleeve 14 may be detachably removed from connector 10, e.g., during shipment, etc., by, for example, snappingly removing projections 28 from groove/recess 26. Prior to installation, locking sleeve 14 may be reattached to connector body 12 in the manner described above.

Figure 6B:
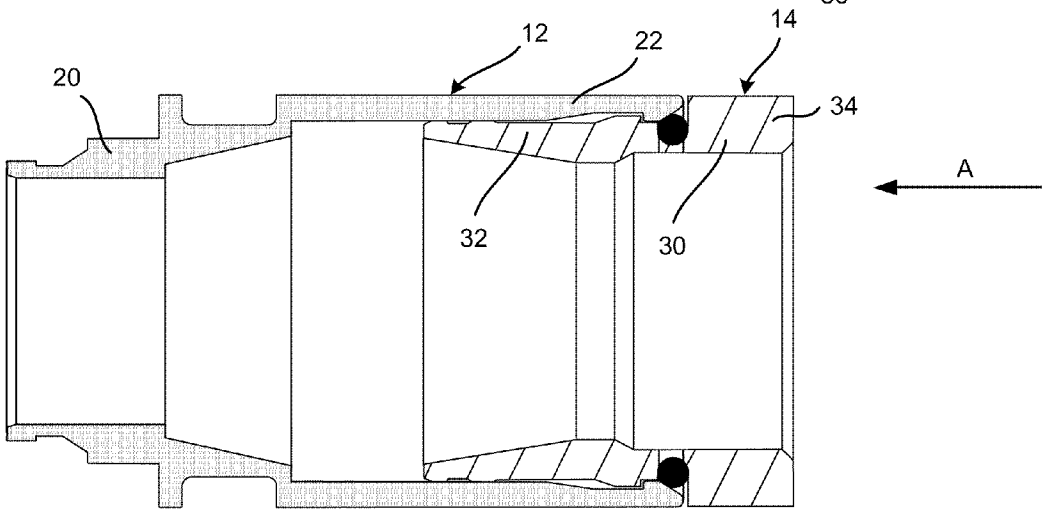

In each case, once the prepared end of a coaxial cable is inserted into connector body 12 so that the cable jacket is separated from the insulator by the sharp edge of annular post 16, locking sleeve 14 may be moved axially forward in direction A from the first position (shown in FIG. 6A) to the second position (shown in FIG. 6B). In some embodiments, a compression tool may be used to advance locking sleeve 14 from the first position to the second position. As locking sleeve 14 moves axially forward in direction A, the cable jacket is compressed within annular chamber 44 to secure the cable in connector 10. Once the cable is secured, connector 10 is ready for attachment to port connector 48, such as an F-81 connector, of a piece of electronic equipment.

As illustrated in FIG. 5, port connector 48 may include a substantially cylindrical body 50 having external threads 52 that match internal threads 54 of annular nut 18. As discussed below with respect to end cap 458, retention force between annular nut 18 and port connector 48 may be enhanced by providing a load force on the port connector 48. In one embodiment, the load force may be a substantially constant force.

Figure 8A:
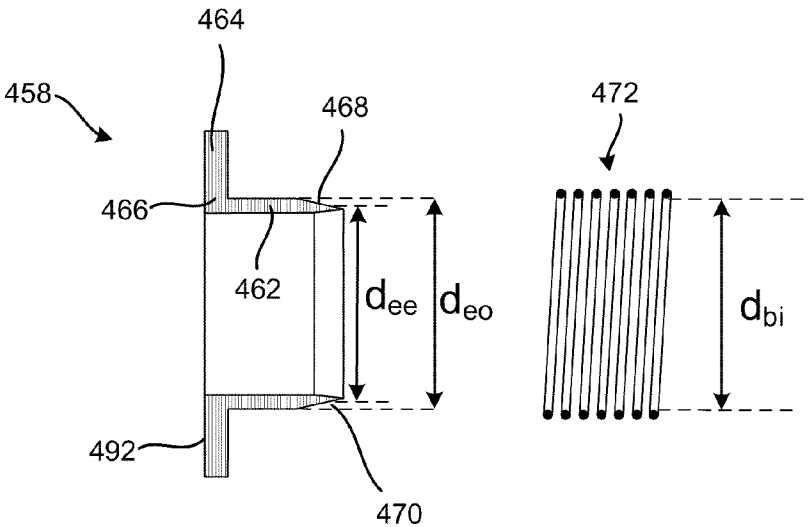

The interaction of end cap 458, biasing element 472, and post 16 to provide a load force is described below with respect to FIGS. 8A through 8F, which shows additional cross-sectional views of these components. As illustrated in FIG. 8A, end cap 458 may include a substantially cylindrical body 462 having a flanged portion 464 extending radially from a forward portion 466 of end cap 458. A forward surface 492 of flanged portion 464 is configured to interface with rearward surface 453 of port connector 48 (shown in FIG. 9) to provide an electrical path during connection of port connector 48 to connector 10.

End cap 458 may also include a rearward portion 468, which may have an outer diameter $d_{ee}$ that is smaller than the outer diameter $d_{eo}$ of body 462. In exemplary end cap 458 (e.g., shown in FIG. 6A), rearward portion 468 may include a tapered annular surface 470 that provides an outer diameter that is less than the outer diameter of end cap body 462. Further, in one embodiment, biasing element 472 may include an inner diameter $d_{bi}$ substantially equal to outer diameter $d_{eo}$ of body 462.

Figure 8B:
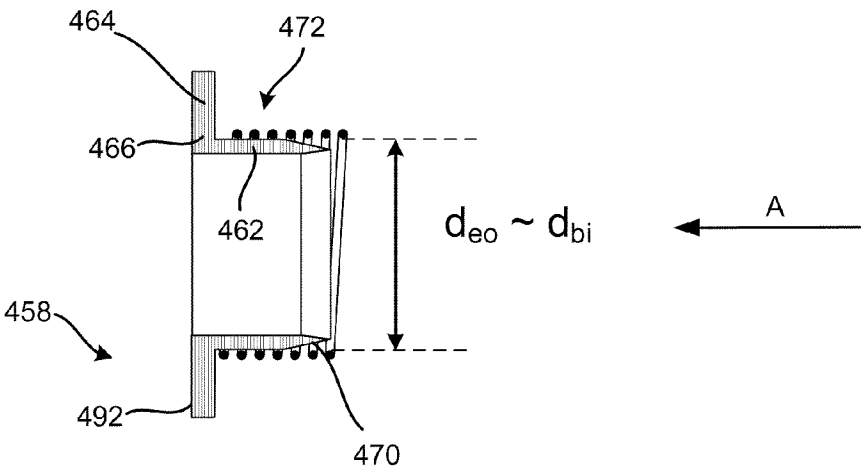

Upon axial insertion of end cap 458 into biasing element 472, as shown in FIG. 8B, rear portion 468 of end cap 458 may pass through inner diameter $d_{bi}$ of biasing element 472 because, as indicated above, the outer diameter of rear portion 468 may be smaller than the inner diameter $d_{bi}$ of biasing element 472. Body 462 of end cap 458, however, may be pressed-fit into biasing portion 472, as outer diameter $d_{eo}$ of body 462 is substantially equal to inner diameter $d_{bi}$ of biasing element 472. Thus, as shown in FIG. 8B, biasing element 472 may be held around body 462 of end cap 458. In other words, end cap 458 may engage biasing element 472 to prevent or inhibit separation of end cap 458 from biasing element 472.

Figure 8C:
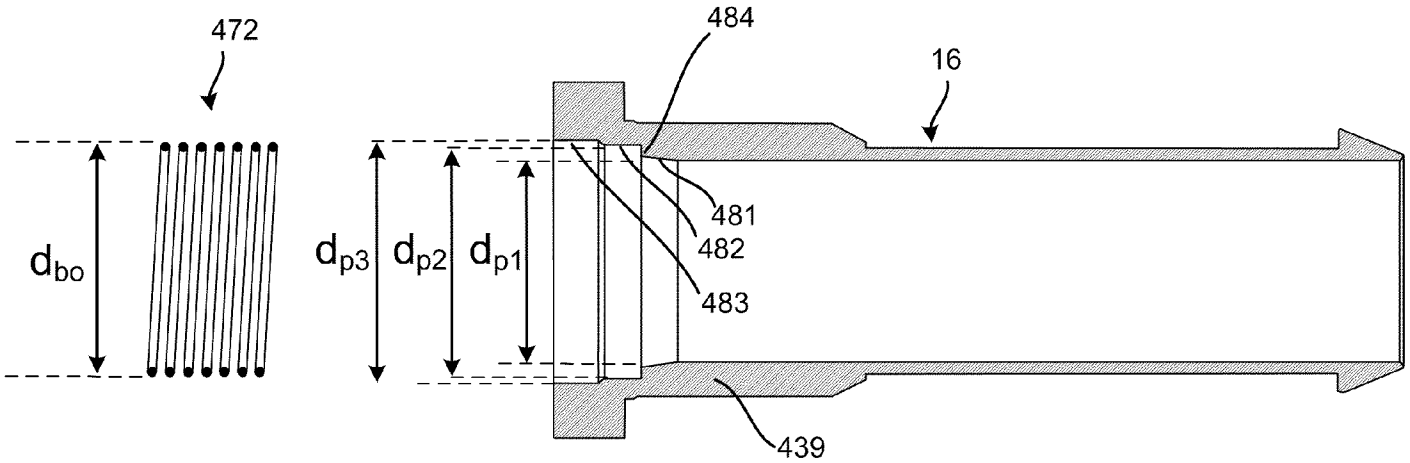
Figure 8D:
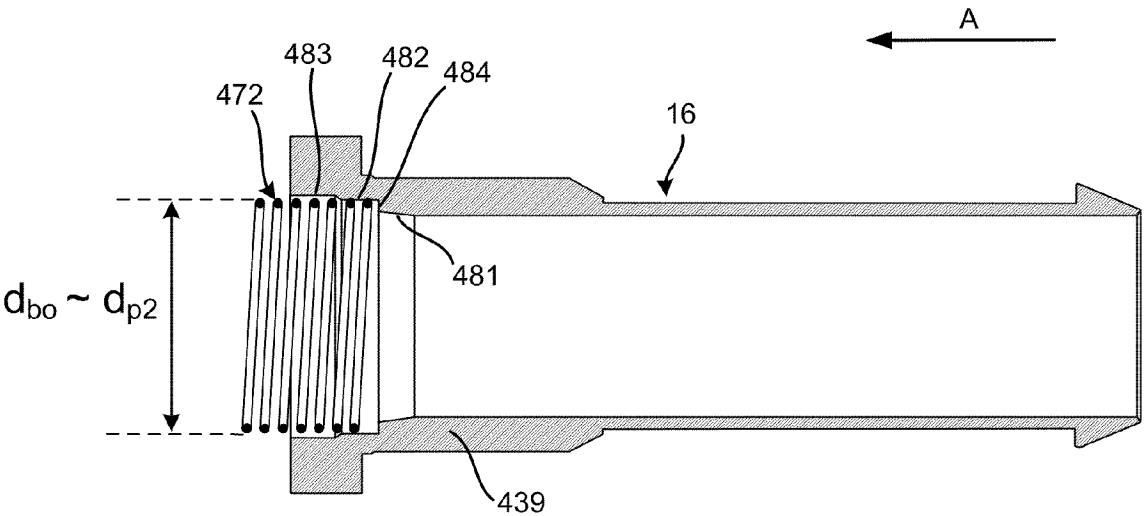

As shown in FIGS. 8C and 8D, front portion 439 of post 16 may include an annular surface 481, an annular surface 482, and an annular surface 483. Each of annular surfaces 481, 482, and 483 may define an inner diameter of front portion 439 of post 16. In the embodiment shown in FIG. 8C, an inner diameter $d_{p1}$ of annular surface 481 is less than an inner diameter $d_{p2}$ of surface 482, which is less than an inner diameter $d_{p3}$ of annular surface 83. As a result, the transition from surface 481 to surface 482 forms an annular edge 484 of post 16. Further, as shown in FIG. 8C, inner diameter $d_{p1}$ may be less than an outer diameter $d_{bo}$ of biasing element 472, inner diameter $d_{p2}$ may be substantially equal to outer diameter $d_{bo}$, and inner diameter $d_{p3}$ may be larger than outer diameter $d_{bo}$.

Thus, in the embodiment shown in FIG. 8D, upon axial insertion of biasing element 472 into front portion 439 of post 16, the rear portion of biasing element 472 may be pressed-fit into front portion 439 of post 16 and against surface 482, as outer diameter $d_{bo}$ of biasing element 472 is substantially equal to inner diameter $d_{p2}$ of post 16. Thus, biasing element 472 may be held in post 16 by, for example, a friction engagement. In other words, post 16 may engage biasing element 472 to prevent or inhibit separation of biasing element 472 from post 16. Biasing element 472, however, cannot move rearward father than ridge 484 because surface 481 has inner diameter $d_{p1}$ less than outer diameter $d_{bo}$ of biasing element 472.

Figure 8E:
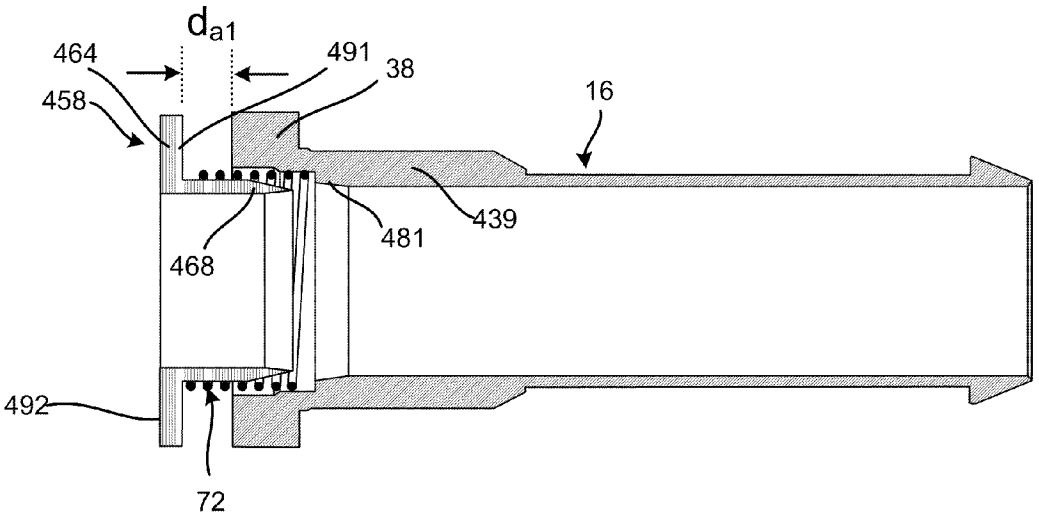

Press fitting end cap 458 into biasing element 472, as shown in FIG. 8B, and biasing element 472 into post 16, as shown in FIG. 8D, may result in the combination of components shown in FIG. 8E. In the embodiment of FIG. 8E, post 16 may engage end cap 458 (using, for example, biasing element 472) to prevent or inhibit separation of end cap 458 from post 16. If post 16 is press fit into body 12, as shown in FIG. 7B, then end cap 458 may be prevented or inhibited from separating from the whole of assembled connector 10, as shown in FIG. 5. With this arrangement, the end cap 458 may be coupled into forward end 439 of post 16. As discussed below, end cap 458 may be axially movable with respect to annular post 16 by compression of biasing element 472.

Biasing element 472 may include a conductive, resilient element configured to provide a suitable biasing force between annular post 16 and end cap 458. The conductive nature of biasing element 472 may also provide an electrical path from surface 453 (e.g., the outer shell) of port connector 48 to annular post 16. In one embodiment, end cap 458 may also be formed of a conductive material, such as metal, to provide an electrical path from surface 453 of port connector 48 the outer shell of port connector 48 and annular post 16.

In one embodiment, biasing element 472 may include one or more coil springs, one or more wave springs (single or double waves), one or more a conical spring washers (slotted or unslotted), one or more Belleville washers, or any other suitable biasing element, such as a conductive resilient element (e.g., a plastic or elastomeric member impregnated or injected with conductive particles), etc.

As illustrated in FIGS. 4, 5, 8A through 8E, and 9, biasing element 472 may include a coil spring having an inner diameter $d_{bi}$ and an outer diameter $d_{bo}$. In one embodiment, inner diameter $d_{bi}$ of biasing element 472 may be sized substantially equal to an outer diameter of end cap cylindrical body 62, such that biasing element 472 may be positioned around cylindrical body 462 of end cap 458 during assembly of connector 10.

In an initial, uncompressed state (as shown in FIG. 8E), biasing element 472 may be in a relaxed state and a first axial distance $d_{a1}$ may exist between an undersurface 491 of flange 464 of end cap 458 and flange 38 of post 16. First axial distance $d_{a1}$ is also shown in FIG. 5 when connector 10 is not connected to connector port 48. A force applied in the rearward direction against a forward surface 492 of flange 464 relative to post 16 may move end cap 458 rearward relative to post 16 and compress biasing element 472.

Figure 8F:
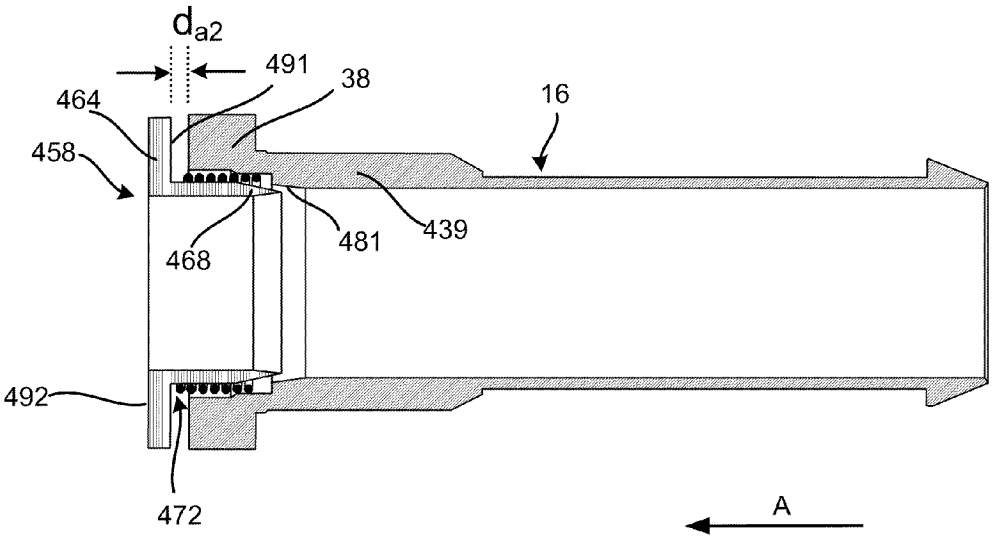
Figure 9:
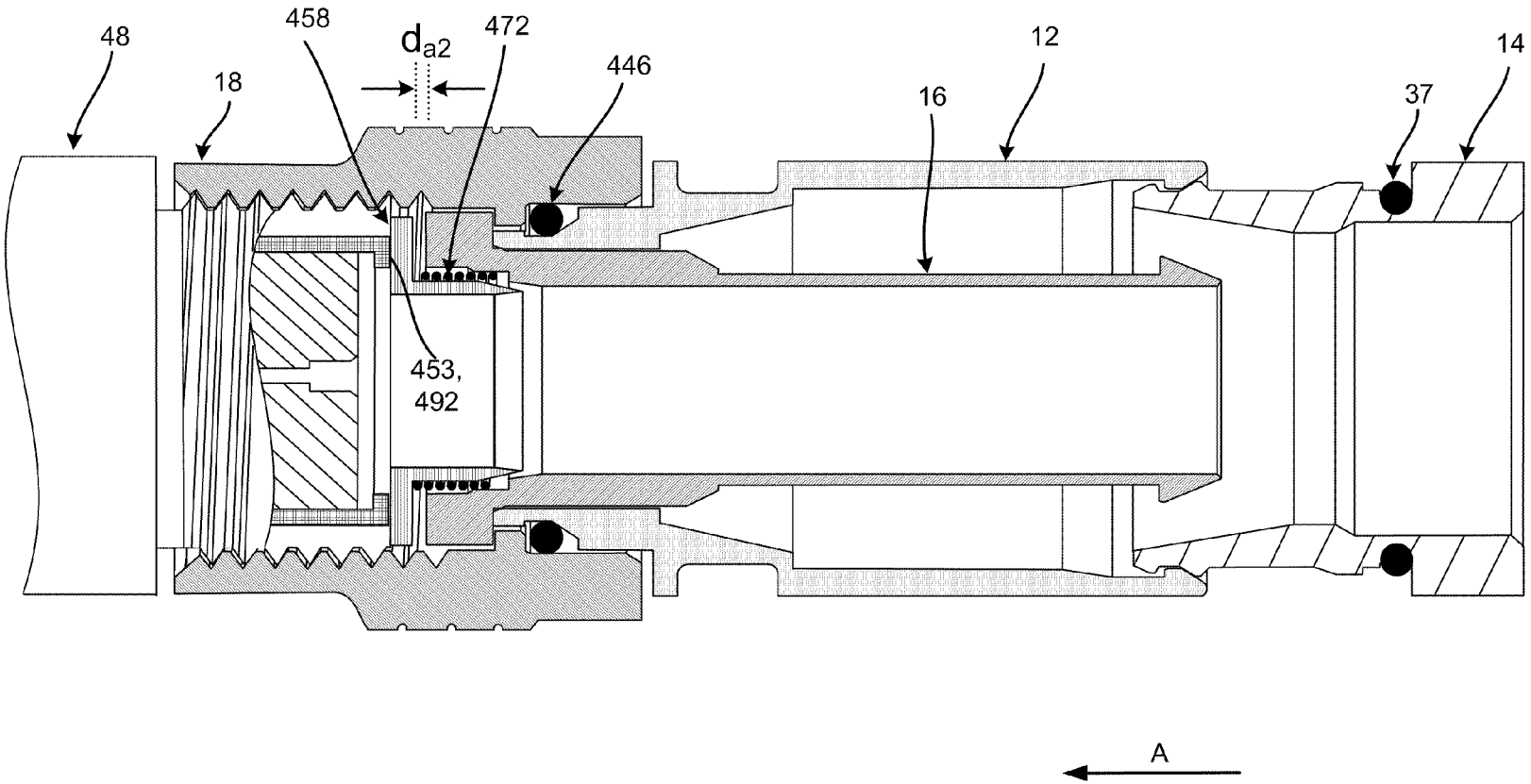
FIG. 9 is a cross-sectional view of the coaxial cable connector of FIG. 4 in an assembled and connected configuration.

In a compressed state (as shown in FIG. 8F), biasing element 472 is compressed, leaving a second axial distance $d_{a2}$ between undersurface 91 of flange 464 of end cap 458 and flange 38 of post 16. The second axial distance $d_{a2}$ is also shown in FIG. 9, where connector 10 is connected to connector port 48. As shown in FIGS. 8E and 8F, first axial distance $d_{a1}$ is less than second axial distance $d_{a2}$. As discussed above, outer diameter $d_{ee}$ of end portion 468 of end cap 458 may be smaller than inner diameter $d_{p1}$ of surface 481. In this embodiment, end portion 468 of end cap 458 may extend into the volume defined inside surface 481.

As shown in FIG. 9, rotatable threaded engagement between threads 52 of port connector 48 and threads 54 of nut 18 may cause the compression of biasing element 472. In this case, rearward surface 453 of port connector 48 may engage forward surface 492 of flanged portion 464 of end cap 458. In a position of initial contact between port connector 48 and end cap 458 (not shown), rearward surface 453 of port connector 48 may be separated by the distance $d_{a1}$ from the forward surface of flanged base portion 38 of annular post 16. The conductive nature of biasing element 472, end cap 458, and annular post 16 may provide an electrical path from the outer shell of port connector 48 to annular post 16. After further rotation of nut 18, in a second position of contact between port connector 48 and end cap 458 (shown in FIG. 9) rearward surface 453 of port connector 48 may be separated by the distance $d_{a2}$ from forward surface 492 of flanged base portion 38 of annular post 16. This configuration may enable a functional gap or "clearance" that may allow for a "back-off" rotation of nut 18 relative to port connector 48 while maintaining suitable passage of electrical and RF signals to annular post 16. In one embodiment, the back-off rotation of nut 18 relative to post 16 may be approximately 360 degrees.

As discussed, continued insertion of port connector 48 into connector 10 may cause biasing element 72 to compress, thereby moving end cap 458 axially relative to annular post 16. The compression of biasing element 472 may provide a load force between flanged base portion 38 and end cap 458, which is then transmitted to port connector 48. This load force is transferred to threads 52 and 54, thereby facilitating constant tension between threads 52 and 54 and facilitating a decreased likelihood that port connector 48 becomes loosened from connector 10 due to external forces, such as vibrations, heating/cooling, etc.

The above-described connector may pass electrical and RF signals typically found in CATV, satellite, CCTV, VoIP, data, video, high speed Internet, etc., through the mating ports (about the connector reference planes). Providing a biasing element, as described above, may also provide power bonding grounding (i.e., helps promote a safer bond connection per NEC® Article 250 when biasing element 72 is under linear compression) & RF shielding (Signal Ingress & Egress).

Upon installation, the annular post 16 may be incorporated into a coaxial cable between the cable foil and the cable braid and may function to carry the RF signals propagated by the coaxial cable. In order to transfer the signals, annular post 16 makes contact with the reference plane of the mating connector (e.g., port connector 48). By providing a spring-loaded end cap 458 for interfacing between post 16 and port connector 48, and biasing the end cap 458 with biasing element 472 located in front of annular post 16, the connector 10 described herein ensures electrical and RF contact at a more uniform reference plane between port connector 48 and annular post 16. Furthermore, by positioning biasing element 472 outside of end cap 458, a more uniform electrically conductive environment may be provided. The stepped nature of post 16 enables compression of biasing element 472, while simultaneously supporting direct interfacing between post 16 and port connector 48. Further, compression of biasing element 472 provides equal and opposite biasing forces between internal threads 54 of nut 18 and external threads 52 of port connector 48.

In one embodiment (not shown), body 462 of end cap 458 may be tapered. In this embodiment, when biasing element 472 is press fit onto end cap 458, end cap 458 may engage the most forward end of biasing element 472 (e.g., the leading coil of biasing element 472 if biasing element 472 is a coil spring).

In yet another embodiment, outer diameter $d_{eo}$ of end cap 458 may be smaller than inner diameter $d_{bi}$ of biasing element 472. In this embodiment, end cap 458 may not tightly hold biasing element 472 and end cap 458 may be inserted into connector 10 (e.g., into nut 38) when connecting to connector port 48. In one embodiment, end cap 458 may be omitted entirely, instead relying on biasing element 472 to provide biasing force against end surface 453 of connector port 48.

In another embodiment, outer diameter $d_{bo}$ of biasing element 472 may be smaller than inner diameter $d_{p2}$ of surface 482 of post 16. In this embodiment, post 16 may not tightly hold biasing element 472 and biasing element 472 (possibly tightly held to end cap 458) may be inserted into connector 10 (e.g., into nut 18) when connecting to connector port 48.

In another embodiment, end cap 458 may be press fit such around biasing element 472 such that biasing element 472 is within the space formed by body 462 of end cap 458. Further, in another embodiment, biasing element 472 may be press fit into post 16 such that a portion of post 16 is within a central space formed by element 472.

Figure 10:
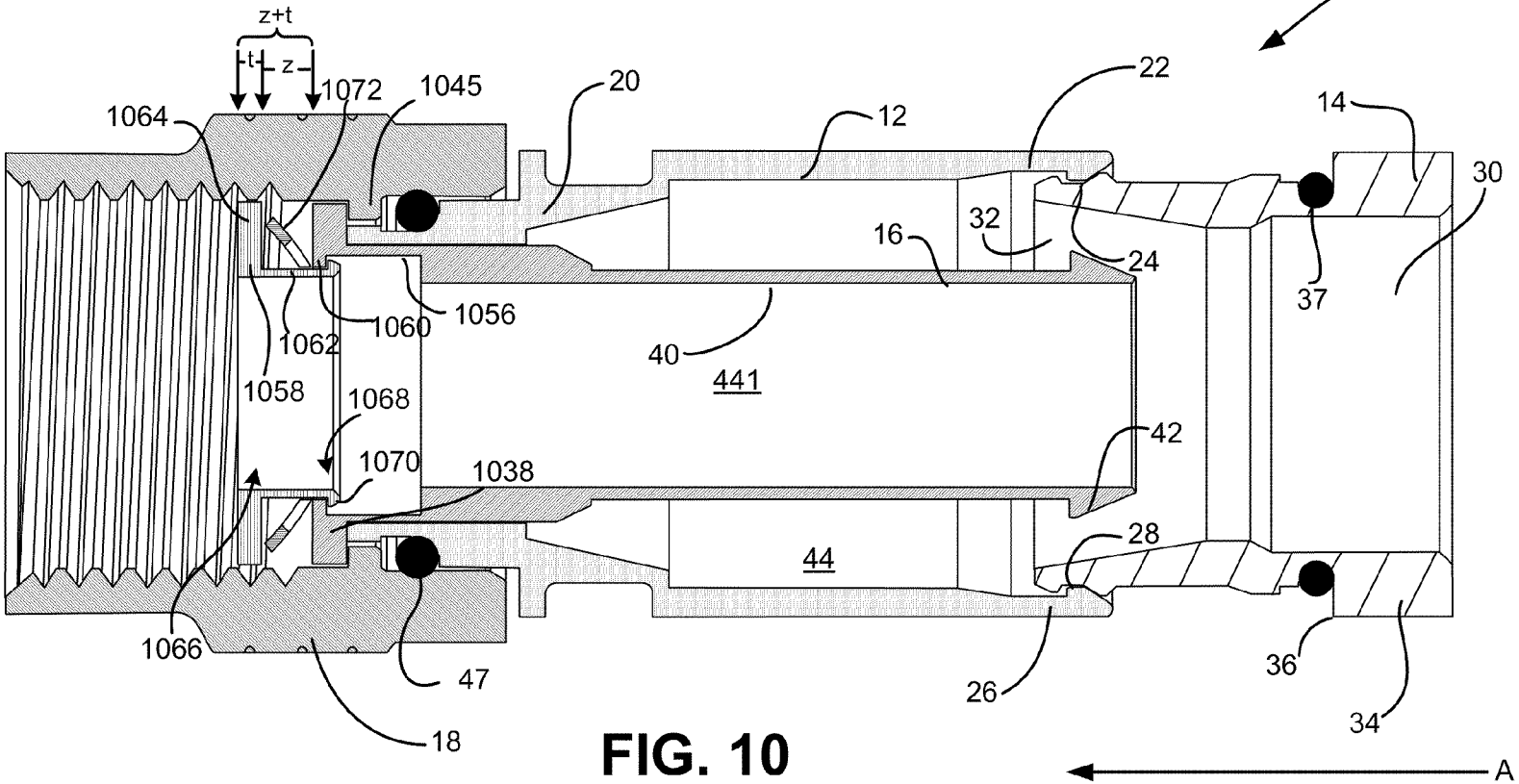
FIG. 10 is a cross-sectional view of another exemplary embodiment of the coaxial cable connector of FIG. 1 in an unconnected configuration.
Figure 11:
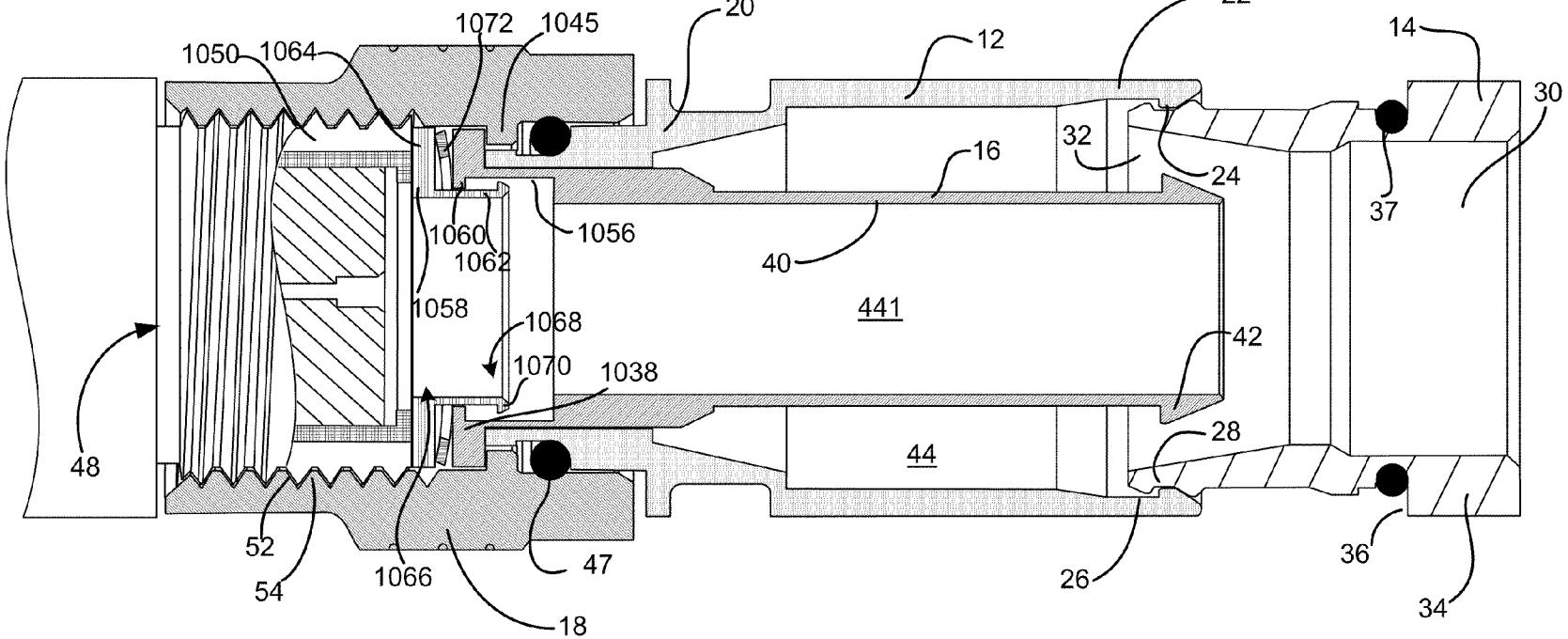
FIG. 11 is a cross-sectional view of the coaxial cable connector of FIG. 10 in a connected configuration.

Referring now to FIGS. 10 and 11, another exemplary embodiment associated with the coaxial cable connector 10 of FIG. 1 is shown. For example, FIGS. 10 and 11 depict an exemplary coaxial cable connector 10 in an unconnected configuration and connected configuration, respectively.

As discussed above, locking sleeve 14 may include a substantially tubular body having a rearward cable receiving end 30 and an opposite forward connector insertion end 32, movably coupled to inner sleeve engagement surface 24 of the connector body 12.

As illustrated in FIGS. 1, 10 and 11, annular nut 18 may be rotatably coupled to forward end 20 of connector body 12. Annular nut 18 may include any number of attaching mechanisms, such as that of a hex nut, a knurled nut, a wing nut, or any other known attaching means, and may be rotatably coupled to connector body 12 for providing mechanical attachment of the connector 10 to an external device via a threaded relationship. Connector 10 may be supplied in the assembled condition, as shown in the drawings, in which locking sleeve 14 is pre-installed inside rearward cable receiving end 22 of connector body 12. In such an assembled condition, a coaxial cable may be inserted through rearward cable receiving end 30 of locking sleeve 14 to engage annular post 16 of connector 10 in the manner described above. In other implementations, locking sleeve 14 may be first slipped over the end of a coaxial cable and the cable (together with locking sleeve 14) may subsequently be inserted into rearward end 22 of connector body 12. As discussed above, in some implementations, locking sleeve 14 may be detachably removed from connector 10, e.g., during shipment, etc., by, for example, snappingly removing projections 28 from groove/recess 26. Prior to installation, locking sleeve 14 may be reattached to connector body 12 in the manner described above.

In each case, once the prepared end of a coaxial cable is inserted into connector body 12 so that the cable jacket is separated from the insulator by the sharp edge of annular post 16, locking sleeve 14 may be moved axially forward in the direction of arrow A from the first position (shown in FIGS. 10 and 11) to the second position (shown in FIG. 1). As illustrated in FIG. 11, port connector 48 may include a substantially cylindrical body 50 having external threads 52 that match internal threads 54 of annular nut 18. As will be discussed in additional detail below, retention force between annular nut 18 and port connector 48 may be enhanced by providing a substantially constant load force on the port connector 48.

To provide this load force, an internal diameter of flanged base portion 38 of annular post 16 may be configured to include an annular notch 1056 for retaining a rearward portion of an end cap 1058. Base portion 1038 may further include a retaining lip 1060 formed at the forward end of base portion 1038 adjacent to annular notch 56 for engagingly receiving end cap 1058. Retaining lip 1060 may have an internal diameter smaller than an internal diameter of annular notch 1056.

As illustrated in FIGS. 10 and 11, end cap 1058 may include a substantially cylindrical body 1062 having a flanged portion 1064 extending radially from a forward portion 1066 of end cap 1058. Flanged portion 1064 is configured to interface with a rearward surface of port connector 48 to provide a uniform reference plane during connection of port connector 48 to connector 10.

Rearward portion 1068 of end cap 1058 may include a radially extending retaining flange 1070 configured to retain end cap 1058 with annular post 16. In one implementation, retaining flange 1070 may be configured to include a rearwardly chamfered outer surface for facilitating insertion of retaining flange 1068 into flanged base portion 38 of annular post 16. Upon axial insertion of end cap 1058 into annular post 16, retaining flange 1068 may engage retaining lip 1060 to prevent or inhibit removal of end cap 1058 from annular post 16. With this arrangement, the end cap 1058 can be easily snap fit into the forward end of flanged base portion 1038. As discussed below, end cap 1058 may be axially movable with respect to annular post 16.

Consistent with embodiments described herein, a biasing element 1072 may be positioned between a rearward surface of flanged portion 1068 and a forward surface of base portion 1064. Biasing element 1072 may include a conductive, resilient element configured to provide a suitable biasing force between annular post 16 and end cap 1058. The conductive nature of biasing element 1072 may also facilitate passage of electrical and RF signals from port connector 48 contacting end cap 1058 (see FIG. 11) to annular post 16 at varying degrees of insertion relative to port connector 48 and connector 10. In one exemplary embodiment, end cap 1058 may also be formed of a conductive material, such as metal, to facilitate transmission of electrical and RF signals between port connector 48 and annular post 16.

In one implementation, biasing element 1072 may include one or more coil springs, one or more wave springs (single or double waves), one or more a conical spring washers (slotted or unslotted), one or more Belleville washers, or any other suitable biasing element, such as a conductive resilient element (e.g., a plastic or elastomeric member impregnated or injected with conductive particles), etc.

Figure 12:
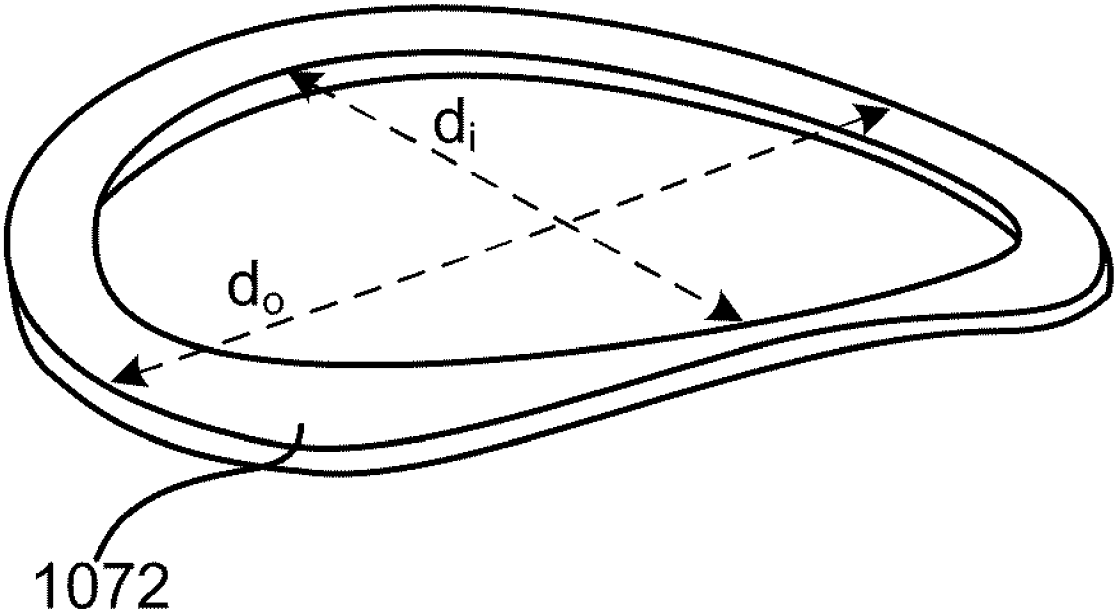
FIG. 12 is an isometric view of an exemplary wave washer-type biasing element consistent with an exemplary embodiment.

As illustrated in FIG. 10-12, biasing element 1072 may include a two-peak wave washer having an inside diameter "$d_i$" and an outside diameter "$d_o$." In one implementation, the inside diameter d, of biasing element 1072 may be sized substantially similarly to an outer diameter of end cap cylindrical body 1062, such that biasing element 1072 may be positioned around end cap cylindrical body 1062 during assembly of connector 10.

In an initial, uncompressed state (as shown in FIG. 10), biasing element 1072 may extend a length "z" beyond the forward end of base portion 1038. Upon insertion of port connector 48 (e.g., via rotatable threaded engagement between threads 52 and threads 54 as shown in FIG. 11), the rearward surface of port connector 48 may engage a forward surface of end cap flanged portion 1064. In a position of initial contact between port connector 48 and end cap 1058 (not shown), the rearward surface of port connector 48 may be separated from the forward surface of annular post 16 by the distance "z"+the thickness of end cap flanged portion 1064, illustrated as "t" in FIG. 10. The conductive nature of biasing element 1072, as well as conduction between end cap 1058 and annular post 16 may enable effective transmission of electrical and RF signals from port connector 48 to annular post 16 even when separated by distance z+t, effectively increasing the reference plane of connector 10. In one implementation, the above-described configuration enables a functional gap or "clearance" between the reference planes, thereby enabling approximately 360 degrees of "back-off" rotation of annular nut 18 relative to port connector 48 while maintaining suitable passage of electrical and RF signals to annular post 16.

Continued insertion of port connector 48 into connector 10 may cause biasing element 1072 to compress, thereby enabling end cap 1058 to move axially within annular post 16. The compression of biasing element 1072 providing a load force between flanged base portion 1038 and end cap 1058, which is then transmitted to port connector 48. This load force is transferred to threads 52 and 54, thereby facilitating constant tension between threads 52 and 54 and facilitating a decreased likelihood that port connector 48 becomes loosened from connector 10 due to external forces, such as vibrations, heating/cooling, etc.

The above-described connector may pass electrical and RF signals typically found in CATV, satellite, CCTV, VoIP, data, video, high speed Internet, etc., through the mating ports (about the connector reference planes). Providing a biasing element, as described above, may also provide power bonding grounding (i.e., helps promote a safer bond connection per NEC® Article 250 when biasing element 1072 is under linear compression) & RF shielding (Signal Ingress & Egress).

Upon installation, the annular post 16 may be incorporated into a coaxial cable between the cable foil and the cable braid and may function to carry the RF signals propagated by the coaxial cable. In order to transfer the signals, annular post 16 makes contact with the reference plane of the mating connector (e.g., port connector 48). By providing a spring-loaded end cap 1058 for interfacing between post 16 and port connector 48, and biasing the end cap 1058 with biasing element 1072 located in front of annular post 16, the connector 10 described herein ensures electrical and RF contact at a more uniform reference plane between port connector 48 and annular post 16. Furthermore, by positioning biasing element 1072 outside of end cap 1058, a more uniform electrically conductive environment may be provided. The stepped nature of post 16 enables compression of biasing element 1072, while simultaneously supporting direct interfacing between post 16 and port connector 48. Further, compression of biasing element 1072 provides equal and opposite biasing forces between internal threads 54 of nut 18 and external threads 52 of port connector 48.

Figure 13:
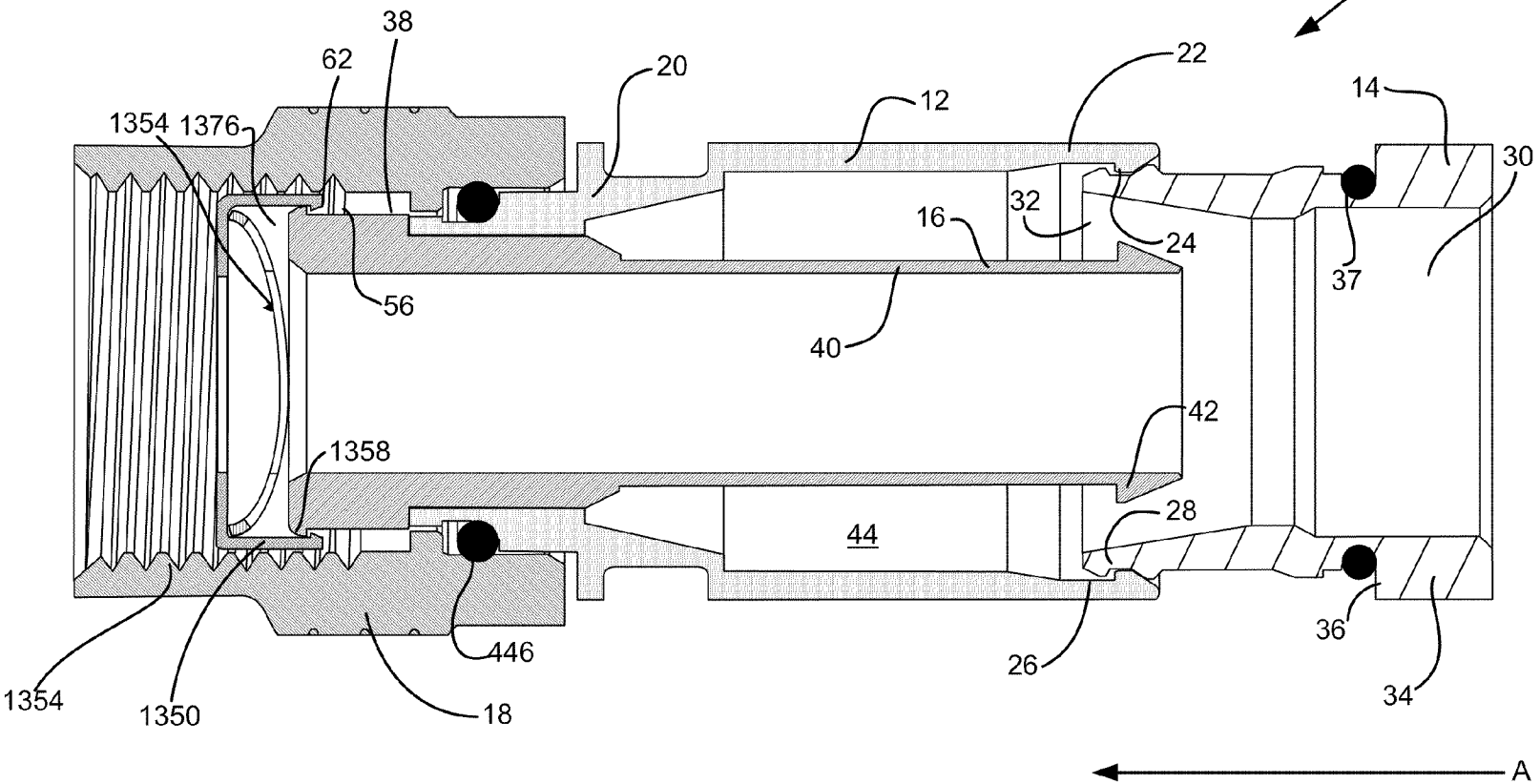
FIG. 13 is a cross-sectional view of another exemplary embodiment of the coaxial cable connector of FIG. 1 in an unconnected configuration.

As described above, biasing elements described above (e.g., biasing element 58, 472 and 1072) enhance retention force between the nut and the port connector by providing a constant load force on the port connector. FIG. 13 illustrates another exemplary embodiment of coaxial cable connector 10 in an unconnected configuration.

Figure 14:
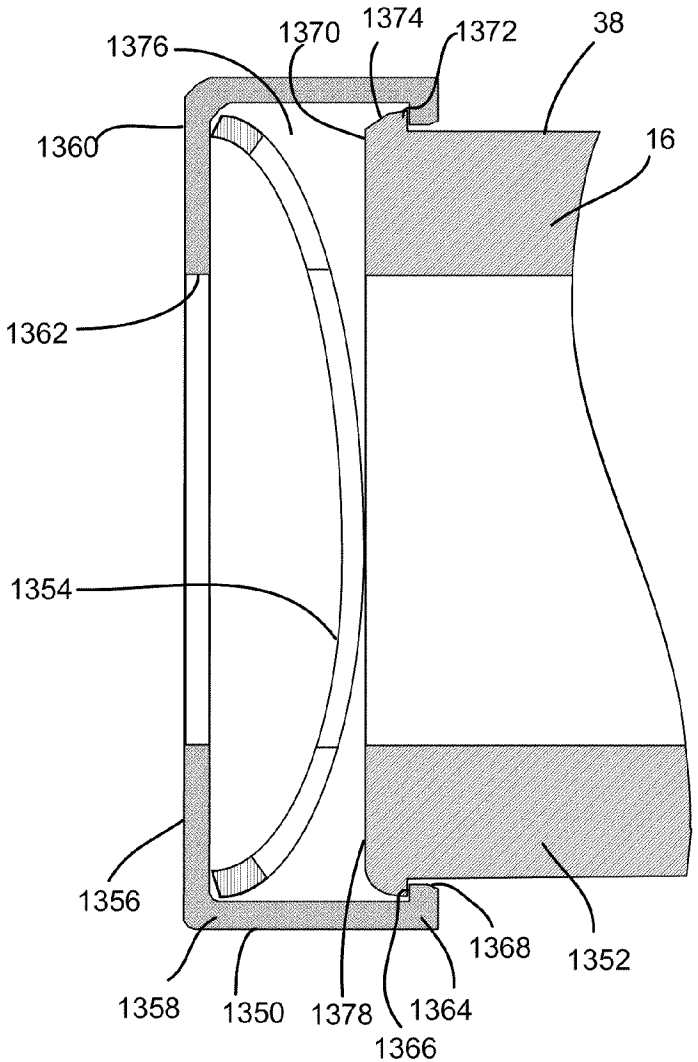
FIG. 14 is an enlarged, isolated cross-sectional view of the forward end of the post with the end cap and the biasing element of FIG. 13.

Referring to FIGS. 13 and 14, connector 10 includes internal threads 1348, which cooperates with an external thread of a mating connector port (not shown). Connector 10 also includes end cap 1350 coupled to the forward end 1352 (shown in FIG. 14) of the shoulder portion 38 of the post 16 and a biasing element 1354 acting between the end cap and the post. As illustrated in FIG. 14, end cap 1350 may be a generally cup-shaped member having a base 1356 and a cylindrical wall 1358 extending generally perpendicularly from the base. Base 1356 has a forward face 1360 and an aperture 1362 formed therethrough, through which the center conductor of a cable extends for connection to the port connector (not shown).

The cylindrical wall 1358 of end cap 1350 terminates at a lip or hook portion 1364 opposite base 1356. Lip 1364 includes a forward facing wall 1366 and a rearward facing chamfered wall 1368. The inner diameter of lip 1364 is slightly larger than the outer diameter of post shoulder portion 38 so that, when assembled to the post, end cap 1350 is in a close axially sliding relationship with the shoulder portion of the post.

Shoulder portion 38 of post 16 is preferably provided with a radial flange 1370 for retaining end cap 1350 to the post. Specifically, radial flange 1370 extends radially outwardly from the outer diameter of post shoulder portion 38 and has an outer diameter slightly smaller than the inner diameter of cylindrical wall 1358 of end cap 1350. Radial flange 1370 further includes a rearward facing wall 1372 and a forward facing chamfered wall 1374.

With this arrangement, end cap 1350 can be easily snap fit over the forward end 1352 of the post shoulder portion. Chamfered walls 1368 and 1374 of end cap 1350 and the post radial flange 1370 facilitate forward insertion of the post into end cap 1350, while forward facing wall 1366 of end cap lip 1364 and rearward facing wall 1372 of post flange 1370 prevent removal of post 16 from within end cap 1350. However, a certain amount of axial movement between end cap 1350 and post 16 is permitted.

Thus assembled, end cap 1350 and post 16 define a chamber 1376 therebetween. Retained within chamber 1376 is biasing element 1354 for urging post 16 and end cap 1350 in axially opposite directions. In its initial non-compressed state, biasing element 1354 preferably separates end cap 1350 and post 16 at their maximum permitted axial distance. As will be discussed in further detail below, biasing element 1354 is compressible so as to permit chamber 1376 to decrease in size.

Biasing element 1354 may be a compression spring, a wave spring (single or double wave), a conical spring washer (slotted or unslotted), a Belleville washer, or any other suitable element for applying a biasing force between the 16 and end cap 1350, without locking post 16 to end cap 1350. In an exemplary implementation, biasing element 1354 may also be made from an electrically conductive material for conducting the electrical signal from post 16 to end cap 1350. For example, biasing element 1354 may be maintained in electrical contact with forward face 1378 of the post shoulder portion 38, and is further maintained in electrical contact with base 1356 of end cap 1350. Thus, electrical continuity is maintained between post 16 and end cap 1350.

Biasing element 1354 provides a biasing force on end cap 1350 urging forward face 1360 of the end cap in a forward direction, as indicated by arrow A in FIG. 13, against a rearward face of a mating external device port upon connection of connector nut 18 with the external device. Biasing element 1354 is also provided to further load the interference between nut threads 48 and the port connector threads to further maintain signal contact between the cable and the port connector.

Retaining biasing element 1354 between end cap 1350 and forward face 1378 of the post shoulder portion 38 provides a constant tension between post 16 and end cap 1350, which allows for up to 360 degree "back-off" rotation of nut 18 on a terminal, without signal loss. As a result, maintaining electrical contact between coaxial cable connector 10 and the signal contact of the port connector is improved by a factor of 400-500%, as compared with prior art connectors.

In addition, as discussed above, in some implementations, locking sleeve 14 illustrated in, for example, FIG. 13, may be detachably removed from connector 10, e.g., during shipment, etc., by, for example, snappingly removing projections 28 from groove/recess 26. Prior to installation, locking sleeve 14 may be reattached to connector body 12 in the manner described above.

As a result of aspects described herein, a spring loaded coaxial RF interface ("F" male connector) is provided that continues to propagate and shield RF signals regardless of torque requirements, such as that recommended by the SCTE. This condition is met when the biasing element is under linear compression and/or the F Male connector-coupling nut allows a gap (clearance) of less than approximately 0.043 inches between the reference planes.

The connector of the present invention passes electrical and RF signals typically found in CATV, satellite, CCTV, VoIP, data, video, high speed Internet, etc., through the mating ports (about the connector reference planes). The spring loaded post provides power bonding grounding (i.e., helps promote a safer bond connection per NEC® Article 250 when spring is under linear compression) & RF shielding (Signal Ingress & Egress).

Upon installation, the connector post is incorporated into the cable between the cable foil and the cable braid and carries the RF signals. In order to transfer the signals, the post must make contact with the reference plane of the mating connector. The wave spring positioned in front of the post flange, and located within the end cap, ensures electrical and RF contact at the reference plane. Also, the recess feature in the end cap retains the spring for compression against the post interface, thereby extending an opposite and equal force against the spring and the post interface. The end cap is retained externally on the post outer diameter with a snap feature and is allowed to axially float. This allows the electrical and RF signals to pass through the reference plane during a 360 degree back off rotation of the connector nut.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

The foregoing description of exemplary implementations provides illustration and description, but is not intended to be exhaustive or to limit the embodiments described herein to the precise form disclosed. Modifications and variations are possible in light of the above teachings or may be acquired from practice of the embodiments.

For example, various features have been mainly described above with respect to coaxial cables and connectors for securing coaxial cables. For example, the coaxial cable connector described herein may be used or usable with various types of coaxial cables, such as 50, 75, or 93 ohm coaxial cables, or other characteristic impedance cable designs. In other implementations, features described herein may be implemented in relation to other types of cable interface technologies.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A coaxial cable connector configured to couple a coaxial cable to a second connector, the coaxial cable connector comprising:

a connector body having a forward end and a rearward end, the forward end being configured to connect to the second connector and the rearward end configured to receive a coaxial cable; a nut rotatably coupled to the forward end of the connector body;

an annular post disposed within the connector body, the annular post include an annular notch located at the forward end of the connector body; and a biasing element located in the annular notch;

wherein the biasing element comprises a coil spring;

wherein the coil spring extends beyond a front surface of the connector body when in an uncompressed state.

2. The coaxial cable connector of claim 1, wherein the coil spring extends approximately 0.05 inches beyond the front surface of the connector body when in the uncompressed state.

3. The coaxial cable connector of claim 1, wherein the coil spring is formed from a conductive material having a diameter of approximately 0.008 inches.

4. The coaxial cable connector of claim 1, wherein the biasing element comprises a coil spring that is configured to provide a biasing force on a front portion of the coaxial cable connector to maintain contact with the second connector.

5. The coaxial cable connector of claim 1, wherein the biasing element is configured to provide electrical and radio frequency connectivity with the second connector when the coaxial cable connector is loosened with respect to the second connector.

6. A coaxial cable connector system, comprising:

a first connector coupled to at least one of video or audio equipment; and a second connector configured to connect to the first connector, the second connector comprising:

a connector body having a forward end and a rearward end, the forward end being configured to connect to the first connector and the rearward end configured to receive a coaxial cable, a nut rotatably coupled to the forward end of the connector body, and an annular post disposed within the connector body, the annular post include a biasing element located in a notch or groove located at the forward end of the connector body, wherein the biasing element extends beyond a front surface of the annular post when the biasing element is in an uncompressed state;

wherein the biasing element comprises a coil spring.

7. The system of claim 6, wherein the wherein the coil spring extends approximately 0.05 inches beyond the front surface of the annular post when in the uncompressed state.

8. A coaxial cable connector for coupling a coaxial cable to a mating connector, the coaxial cable connector comprising:

a connector body having a forward end and a rearward cable receiving end for receiving a cable;

a nut rotatably coupled to the forward end of the connector body;

an annular post disposed within the connector body, the annular post including an inner chamber extending axially therethrough;

an end cap having a body and a forward flanged portion, wherein the end cap is movable in an axial direction relative to the post; and a biasing element, between the end cap and the post, for biasing the end toward a connector port.

9. The coaxial cable connector of claim 8, wherein the biasing element is press fit between the end cap and the post.

10. The coaxial cable connector of claim 8, wherein the nut includes an inwardly directed flange that engages the annular post and retains the nut in an axially fixed position relative to the annular post.

11. The coaxial cable connector of claim 8, wherein the biasing element comprises a compression spring, a wave spring, a conical spring washer, a Belleville washer, or a compressible resilient elastomeric element or material.

12. The coaxial cable connector of claim 8, wherein the end cap is electrically conductive.

13. A coaxial cable connector for coupling a coaxial cable to a mating connector, the coaxial cable connector comprising:

a connector body having a forward end and a rearward cable receiving end for receiving a cable;

a nut rotatably coupled to the forward end of the connector body;

an annular post disposed within the connector body, the annular post having a forward flanged base portion located adjacent a rearward portion of the nut, the annular post including an inner chamber extending axially therethrough;

an end cap having a body and a forward flanged portion, wherein the end cap body is axially movably coupled to said forward flanged base portion of said post; and a biasing element, positioned between the forward flanged base portion and the forward flanged portion of the end cap, acting between the annular post and the end cap.

14. The coaxial cable connector of claim 13, wherein the nut includes an inwardly directed flange that engages the annular post and retains the nut in an axially fixed position relative to the annular post.

15. The coaxial cable connector of claim 13, wherein the biasing element comprises a compression spring, a wave spring, a conical spring washer, a Belleville washer, or an elastomeric element.

16. The coaxial cable connector of claim 13, wherein an outside diameter of the end cap body is substantially similar to an inside diameter of the forward flanged base portion.

17. The coaxial cable connector of claim 13, wherein the forward flanged base portion comprises an annular notch and a retaining lip formed at the forward end of the flanged base portion adjacent the annular notch; and wherein a rearward end of the end cap body comprises a retaining flange for engaging the retaining lip upon insertion of the end cap body into the inner chamber of the annular post.

18. The coaxial cable connector of claim 13, wherein an inside diameter of the biasing element is substantially similar to an outside diameter of the end cap body.

19. In combination:

a connector having a rearward surface; and a coaxial cable connector connected to said connector, the coaxial cable connector comprising:

a connector body having a forward end and a rearward cable receiving end for receiving a cable;

a nut rotatably coupled to the forward end of the connector body;

an annular post disposed within the connector body, the annular post having a forward flanged base portion located adjacent a rearward portion of the nut, the annular post including an inner chamber extending axially therethrough;

an end cap having a body and a forward flanged portion, wherein the end cap body is axially movably coupled to said forward flanged base portion of said post via the inner chamber, the end cap having a forward surface that engages the rearward surface of the connector; and a biasing element, positioned between the forward flanged base portion and the forward flanged portion of the end cap, acting between said post and said end cap, wherein the biasing element is configured to be compressed between the end cap flanged portion and the annular post flanged base portion.

20. The combination of claim 19, wherein the biasing element comprises a compression spring, a wave spring, a conical spring washer, a Belleville washer, or an elastomeric element.

21. The combination of claim 19, wherein the connector includes a substantially cylindrical body having a number of external threads, and wherein the nut includes a number of internal threads for engaging the external threads of the connector, and wherein compression of the biasing element induces a spring load force between the internal threads of the nut and the external threads of the connector.

22. A coaxial cable connector for coupling a coaxial cable to a mating connector, the connector comprising:

a connector body having a forward end and a rearward cable receiving end for receiving a cable;

a nut rotatably coupled to said forward end of said connector body;

an annular post disposed within said connector body, said post having a forward flanged base portion disposed within a rearward extent of said nut;

an end cap axially movably coupled to said forward flanged base portion of said post; and a biasing element acting between said post and said end cap.

23. The coaxial cable connector of claim 22, wherein the biasing element comprises a compression spring, a wave spring, a conical spring washer, a Belleville washers or a compressible O-ring.

24. In combination:

a connector terminal including a rearward facing wall; and a coaxial cable connector connected to said connector terminal, said coaxial cable connector comprising:

a connector body having a forward end and a rearward cable receiving end for receiving a cable;

a nut rotatably coupled to said forward end of said connector body;

an annular post disposed within said connector body, said post having a forward flanged base portion disposed within a rearward extent of said nut;

an end cap axially movably coupled to said forward flanged base portion of said post;

a biasing element acting between said post and said end cap to urge a forward facing wall of said end cap against the rearward facing wall of said connector terminal.

* * * * *